US008029155B2

(12) United States Patent
Van De Ven et al.

(10) Patent No.: US 8,029,155 B2
(45) **Date of Patent: *Oct. 4, 2011**

(54) LIGHTING DEVICE AND LIGHTING METHOD

(75) Inventors: Antony Paul Van De Ven, Hong Kong Sar (CN); Gerald H. Negley, Durham, NC (US)

(73) Assignee: Cree, Inc., Durham, NC (US)

( * ) Notice: Subject to any disclaimer, the term of this patent is extended or adjusted under 35 U.S.C. 154(b) by 579 days.

This patent is subject to a terminal disclaimer.

(21) Appl. No.: 11/936,163

(22) Filed: Nov. 7, 2007

(65) Prior Publication Data

US 2008/0106895 A1 May 8, 2008

Related U.S. Application Data

(60) Provisional application No. 60/857,305, filed on Nov. 7, 2006.

(51) Int. Cl.
*F21V 9/00* (2006.01)

(52) U.S. Cl. ..... 362/231; 362/545; 257/89; 257/98; 313/485; 315/307

(58) Field of Classification Search ..... 362/84, 362/231, 260, 545, 612, 800; 257/89, 98; 313/483, 485, 487; 315/185 S, 200 A, 291, 315/307, 312, 322–324; 345/82, 83, 102
See application file for complete search history.

(56) References Cited

U.S. PATENT DOCUMENTS 3,805,937 A 4/1974 Hatanaka et al.
3,875,456 A 4/1975 Kano et al.
3,927,290 A 12/1975 Denley
4,120,026 A 10/1978 Tsuchihashi et al.
4,325,146 A 4/1982 Lennington
4,408,157 A 10/1983 Beaubien
4,420,398 A 12/1983 Castino
4,710,699 A 12/1987 Miyamoto
5,087,883 A 2/1992 Hoffman
5,264,997 A 11/1993 Hutchinsson et al.
5,407,799 A 4/1995 Studier (Continued)

FOREIGN PATENT DOCUMENTS

DE 3 916 875 12/1990

(Continued)

OTHER PUBLICATIONS

U.S. Appl. No. 12/248,220, filed Oct. 9, 2008.

(Continued)

*Primary Examiner* — Stephen F Husar
*Assistant Examiner* — Meghan K Dunwiddie
(74) *Attorney, Agent, or Firm* — Burr & Brown

(57) ABSTRACT

There is provided a lighting device comprising one or more groups of solid state light emitters and one or more groups of lumiphors, which emits mixed illumination having x, y color coordinates within a region defined by (0.32, 0.40), (0.36, 0.38), (0.41, 0.455), and (0.36, 0.48). Also, such lighting devices which emit light having x, y color coordinates within other specified regions. Also, such lighting devices with respective groups which emit light within two specified regions, and which mix to produce light within such regions. Also, methods of lighting light from such emitters and/or lumiphors.

35 Claims, 4 Drawing Sheets

U.S. PATENT DOCUMENTS

| | | | |
|---|---|---|---|
| 5,410,519 | A | 4/1995 | Hall et al. |
| 5,477,436 | A | 12/1995 | Betling et al. |
| 5,563,849 | A | 10/1996 | Hall et al. |
| 5,803,579 | A | 9/1998 | Turnbull et al. |
| 5,851,063 | A | 12/1998 | Doughty et al. |
| 5,959,316 | A | 9/1999 | Lowery |
| 6,066,861 | A | 5/2000 | Hohn et al. |
| 6,076,936 | A | 6/2000 | George |
| 6,084,250 | A | 7/2000 | Justel et al. |
| 6,095,666 | A | 8/2000 | Salam |
| 6,132,072 | A | 10/2000 | Turnbull et al. |
| 6,153,971 | A | 11/2000 | Shimizu et al. |
| 6,212,213 | B1 | 4/2001 | Weber et al. |
| 6,234,648 | B1 | 5/2001 | Borner et al. |
| 6,252,254 | B1 | 6/2001 | Soules |
| 6,255,670 | B1 | 7/2001 | Srivastava et al. |
| 6,278,135 | B1 | 8/2001 | Srivastava et al. |
| 6,292,901 | B1 | 9/2001 | Lys et al. |
| 6,294,800 | B1 | 9/2001 | Duggal et al. |
| 6,319,425 | B1 | 11/2001 | Tasaki et al. |
| 6,335,538 | B1 | 1/2002 | Prutchi et al. |
| 6,337,536 | B1 | 1/2002 | Matsubara et al. |
| 6,348,766 | B1 | 2/2002 | Ohishi et al. |
| 6,350,041 | B1 | 2/2002 | Tarsa et al. |
| 6,357,889 | B1 | 3/2002 | Duggal et al. |
| 6,394,621 | B1 | 5/2002 | Hanewinkel |
| 6,429,583 | B1 | 8/2002 | Levinson et al. |
| 6,441,558 | B1 | 8/2002 | Muthu et al. |
| 6,480,299 | B1 | 11/2002 | Drakopoulos et al. |
| 6,501,100 | B1 | 12/2002 | Srivastava et al. |
| 6,504,179 | B1 | 1/2003 | Ellens et al. |
| 6,513,949 | B1 | 2/2003 | Marshall et al. |
| 6,522,065 | B1 | 2/2003 | Srivastava et al. |
| 6,538,371 | B1 | 3/2003 | Duggal et al. |
| 6,550,949 | B1 | 4/2003 | Bauer et al. |
| 6,552,495 | B1 | 4/2003 | Chang |
| 6,577,073 | B2 | 6/2003 | Shimizu et al. |
| 6,578,986 | B2 | 6/2003 | Swaris et al. |
| 6,592,810 | B2 | 7/2003 | Nishida et al. |
| 6,600,175 | B1 | 7/2003 | Baretz et al. |
| 6,600,324 | B2 | 7/2003 | St-Germain |
| 6,603,258 | B1 | 8/2003 | Mueller-Mach et al. |
| 6,608,485 | B2 | 8/2003 | St-Germain |
| 6,616,862 | B2 | 9/2003 | Srivastava et al. |
| 6,624,350 | B2 | 9/2003 | Nixon et al. |
| 6,636,003 | B2 | 10/2003 | Rahm et al. |
| 6,642,666 | B1 | 11/2003 | St-Germain |
| 6,685,852 | B2 | 2/2004 | Setlur et al. |
| 6,686,691 | B1 | 2/2004 | Mueller et al. |
| 6,692,136 | B2 | 2/2004 | Marshall et al. |
| 6,703,173 | B2 | 3/2004 | Lu et al. |
| 6,712,486 | B1 | 3/2004 | Popovich et al. |
| 6,737,801 | B2 | 5/2004 | Ragle |
| 6,744,194 | B2 | 6/2004 | Fukasawa et al. |
| 6,762,563 | B2 | 7/2004 | St-Germain |
| 6,784,463 | B2 | 8/2004 | Camras et al. |
| 6,791,257 | B1 | 9/2004 | Sato et al. |
| 6,817,735 | B2 | 11/2004 | Shimizu et al. |
| 6,841,804 | B1 | 1/2005 | Lung-Chien et al. |
| 6,851,834 | B2 | 2/2005 | Leysath |
| 6,880,954 | B2 | 4/2005 | Ollet et al. |
| 6,882,101 | B2 | 4/2005 | Ragle |
| 6,914,267 | B2 | 7/2005 | Fukasawa et al. |
| 6,936,857 | B2 | 8/2005 | Doxsee et al. |
| 6,967,116 | B2 | 11/2005 | Negley |
| 7,005,679 | B2 | 2/2006 | Tarsa et al. |
| 7,008,078 | B2 | 3/2006 | Shimizu et al. |
| 7,009,343 | B2 | 3/2006 | Lim et al. |
| 7,014,336 | B1 | 3/2006 | Ducharme et al. |
| 7,023,019 | B2 | 4/2006 | Maeda et al. |
| 7,061,454 | B2 | 6/2006 | Sasuga et al. |
| 7,066,623 | B2 | 6/2006 | Lee et al. |
| 7,083,302 | B2 | 8/2006 | Chen et al. |
| 7,093,958 | B2 | 8/2006 | Coushaine |
| 7,095,056 | B2 | 8/2006 | Vitta et al. |
| 7,102,172 | B2 | 9/2006 | Lynch et al. |
| 7,125,143 | B2 | 10/2006 | Hacker |
| 7,135,644 | B1 | 11/2006 | Vornsand et al. |
| 7,135,664 | B2 | 11/2006 | Vornsand et al. |
| 7,144,121 | B2 | 12/2006 | Minano et al. |
| 7,164,231 | B2 | 1/2007 | Choi et al. |
| 7,207,691 | B2 | 4/2007 | Lee et al. |
| 7,213,940 | B1 | 5/2007 | Van De Ven et al. |
| 7,215,074 | B2 | 5/2007 | Shimizu et al. |
| 7,232,212 | B2 | 6/2007 | Iwase |
| 7,239,085 | B2 | 7/2007 | Kawamura |
| 7,250,715 | B2 | 7/2007 | Meuller et al. |
| 7,255,457 | B2 | 8/2007 | Ducharme et al. |
| 7,256,557 | B2 | 8/2007 | Lim |
| 7,329,024 | B2 | 2/2008 | Lynch et al. |
| 7,358,954 | B2 | 4/2008 | Negley |
| 7,365,485 | B2 | 4/2008 | Fukasawa et al. |
| 7,387,405 | B2 | 6/2008 | Ducharme et al. |
| 7,422,504 | B2 | 9/2008 | Maeda et al. |
| 7,453,195 | B2 | 11/2008 | Radkov |
| 7,474,044 | B2 | 1/2009 | Ge |
| 2001/0002049 | A1 | 5/2001 | Reeh et al. |
| 2002/0070681 | A1 | 6/2002 | Shimizu et al. |
| 2002/0087532 | A1 | 7/2002 | Barritz et al. |
| 2003/0026096 | A1 | 2/2003 | Ellens et al. |
| 2003/0030063 | A1 | 2/2003 | Sosniak |
| 2003/0067773 | A1 | 4/2003 | Marshall et al. |
| 2003/0146411 | A1 | 8/2003 | Srivastava et al. |
| 2003/0222268 | A1 | 12/2003 | Yocom et al. |
| 2004/0046178 | A1 | 3/2004 | Sano |
| 2004/0105261 | A1 | 6/2004 | Ducharme et al. |
| 2004/0105264 | A1 | 6/2004 | Spero |
| 2004/0021299 | A1 | 10/2004 | Mohacsi |
| 2004/0212998 | A1 | 10/2004 | Mohacsi |
| 2004/0217364 | A1 | 11/2004 | Tarsa et al. |
| 2004/0218387 | A1 | 11/2004 | Gerlach |
| 2004/0264193 | A1 | 12/2004 | Okumura |
| 2005/0052378 | A1 | 3/2005 | Hacker |
| 2005/0082974 | A1 | 4/2005 | Fukasawa et al. |
| 2005/0243556 | A1 | 11/2005 | Lynch |
| 2005/0251698 | A1 | 11/2005 | Lynch et al. |
| 2005/0259423 | A1 | 11/2005 | Heuser et al. |
| 2005/0274972 | A1 | 12/2005 | Roth et al. |
| 2006/0012989 | A1 | 1/2006 | Lee |
| 2006/0022582 | A1 | 2/2006 | Radkov |
| 2006/0060872 | A1 | 3/2006 | Edmond et al. |
| 2006/0067073 | A1 | 3/2006 | Ting |
| 2006/0091778 | A1 | 5/2006 | Setlur et al. |
| 2006/0105482 | A1 | 5/2006 | Alferink et al. |
| 2006/0113548 | A1 | 6/2006 | Chen et al. |
| 2006/0138435 | A1 | 6/2006 | Tarsa et al. |
| 2006/0138937 | A1 | 6/2006 | Ibbetson |
| 2006/0152140 | A1 | 7/2006 | Brandes |
| 2006/0180818 | A1 | 8/2006 | Nagai et al. |
| 2006/0181192 | A1 | 8/2006 | Radkov |
| 2006/0245184 | A1 | 11/2006 | Galli |
| 2007/0001188 | A1 | 1/2007 | Lee |
| 2007/0041220 | A1 | 2/2007 | Lynch |
| 2007/0051966 | A1 | 3/2007 | Higashi et al. |
| 2007/0090381 | A1 | 4/2007 | Otsuka et al. |
| 2007/0137074 | A1 | 6/2007 | Van De Ven et al. |
| 2007/0139920 | A1 | 6/2007 | Van De Ven et al. |
| 2007/0139923 | A1 | 6/2007 | Negley |
| 2007/0170447 | A1 | 7/2007 | Negley |
| 2007/0171145 | A1 | 7/2007 | Coleman et al. |
| 2007/0202623 | A1 | 8/2007 | Gao |
| 2007/0223219 | A1 | 9/2007 | Medendorp et al. |
| 2007/0236911 | A1 | 10/2007 | Negley |
| 2007/0247414 | A1 | 10/2007 | Robert |
| 2007/0247847 | A1 | 10/2007 | Villard |
| 2007/0262337 | A1 | 11/2007 | Villard |
| 2007/0263393 | A1 | 11/2007 | Van De Ven et al. |
| 2007/0267983 | A1 | 11/2007 | Van De Ven et al. |
| 2007/0274063 | A1 | 11/2007 | Negley |
| 2007/0274080 | A1 | 11/2007 | Negley et al. |
| 2007/0276606 | A1 | 11/2007 | Radkov |
| 2007/0278503 | A1 | 12/2007 | Van De Ven et al. |
| 2007/0278934 | A1 | 12/2007 | Van De Ven et al. |
| 2007/0278974 | A1 | 12/2007 | Van De Ven |
| 2007/0279440 | A1 | 12/2007 | Van De Vent et al. |
| 2007/0279903 | A1 | 12/2007 | Negley |
| 2007/0280624 | A1 | 12/2007 | Negley et al. |

| | | | |
|---|---|---|---|
| 2008/0084685 | A1 | 4/2008 | Van De Ven |
| 2008/0084700 | A1 | 4/2008 | Negley |
| 2008/0084701 | A1 | 4/2008 | Van De Ven et al. |
| 2008/0088248 | A1 | 4/2008 | Myers |
| 2008/0089053 | A1 | 4/2008 | Negley |
| 2008/0106895 | A1 | 5/2008 | Van De Ven |
| 2008/0106907 | A1 | 5/2008 | Trott et al. |
| 2008/0112168 | A1 | 5/2008 | Pickard et al. |
| 2008/0112170 | A1 | 5/2008 | Trott et al. |
| 2008/0112183 | A1 | 5/2008 | Negley |
| 2008/0130265 | A1 | 6/2008 | Negley |
| 2008/0130285 | A1 | 6/2008 | Negley |
| 2008/0136313 | A1 | 6/2008 | Negley |
| 2008/0137347 | A1 | 6/2008 | Trott et al. |
| 2008/0170396 | A1 | 7/2008 | Yuan et al. |
| 2008/0179602 | A1 | 7/2008 | Negley |
| 2008/0192462 | A1 | 8/2008 | Steedly et al. |
| 2008/0192493 | A1 | 8/2008 | Villard |
| 2008/0211416 | A1 | 9/2008 | Negley et al. |
| 2008/0231201 | A1 | 9/2008 | Higley et al. |
| 2008/0259589 | A1 | 10/2008 | Van De Ven et al. |
| 2008/0278928 | A1 | 11/2008 | Van De Ven et al. |
| 2008/0278940 | A1 | 11/2008 | Van De Ven et al. |
| 2008/0278950 | A1 | 11/2008 | Pickard et al. |
| 2008/0278952 | A1 | 11/2008 | Trott et al. |
| 2008/0304260 | A1 | 12/2008 | Van De Ven et al. |
| 2008/0304261 | A1 | 12/2008 | Van De Ven et al. |
| 2008/0304269 | A1 | 12/2008 | Pickard et al. |
| 2008/0309255 | A1 | 12/2008 | Myers |
| 2008/0310154 | A1 | 12/2008 | Van De Ven et al. |
| 2009/0002986 | A1 | 1/2009 | Medendorp et al. |

FOREIGN PATENT DOCUMENTS

| | | |
|---|---|---|
| DE | 3916875 | 12/1990 |
| DE | 10-335077 | 3/2005 |
| EP | 0 838 866 | 4/1998 |
| EP | 0 971 421 | 1/2000 |
| EP | 1 024 399 | 8/2000 |
| EP | 1 081 771 | 3/2001 |
| EP | 1 160 883 | 12/2001 |
| EP | 1 193 772 | 4/2002 |
| EP | 1 367 655 | 12/2003 |
| EP | 1 462 711 | 12/2004 |
| EP | 1 566 848 | 8/2005 |
| EP | 1 571 715 | 9/2005 |
| EP | 1 760 795 | 1/2006 |
| JP | 10-163535 | 6/1998 |
| JP | 2000-022222 | 1/2000 |
| JP | 2000-183408 | 6/2000 |
| JP | 2001-111114 | 4/2001 |
| JP | 2001-156331 | 6/2001 |
| JP | 2001-307506 | 11/2001 |
| JP | 2002-150821 | 5/2002 |
| JP | 2003-515956 | 5/2003 |
| JP | 2003-529889 | 10/2003 |
| JP | 2004-080046 | 3/2004 |
| JP | 2004-103443 | 4/2004 |
| JP | 2004-253309 | 9/2004 |
| JP | 2004-356116 | 12/2004 |
| JP | 2004-363055 | 12/2004 |
| JP | 2005-005482 | 1/2005 |
| JP | 2005-101296 | 4/2005 |
| JP | 2005-142311 | 6/2005 |
| JP | 2007-122950 | 5/2007 |
| JP | 2007-141737 | 6/2007 |
| TW | 546854 | 8/2003 |
| WO | 98/43014 | 10/1998 |
| WO | 00/34709 | 6/2000 |
| WO | 01/41215 | 6/2001 |
| WO | 01/69692 | 9/2001 |
| WO | 2004/068909 | 8/2004 |
| WO | 2005/004202 | 1/2005 |
| WO | 2005013365 | 2/2005 |
| WO | 2005/013365 | 10/2005 |
| WO | 2005/124877 | 12/2005 |
| WO | 2005124877 | 12/2005 |
| WO | WO 2005/124877 | 12/2005 |
| WO | 2006/028312 | 3/2006 |
| WO | 2007/061758 | 5/2007 |

OTHER PUBLICATIONS

U.S. Appl. No. 12/277,745, filed Nov. 25, 2008.

White Light LED, Part Nos. NSPW300BS and NSPW312BS, High Brightness LEDs, November 12, 1999, Publisher: Nichia Corporation.

Color Kinetics Inc., Color Kinetics Support : White Papers & Presentations; available at http://www.colorkinetics.com/support/whitepapers/:, Solid State Lighting White Papers & Presentations, Feb. 22, 2006, pp. 1-4.

Compound Semiconductors Online, "LED Lighting Fixtures, Inc. Sets World Record at 80 Lumens per Watt for Warm White", Compound Semiconductors Online, May 30, 2006, pp. 1.

Krames et al., *Lumileds Lighting, Light from Silicon Valley*, Progress and Future Direction of LED Technology, SSL Workshop, Nov. 13, 2003, Publisher: Limileds Lighting Inc., pp. 1-21.

Nichia, White Light LED, Part Nos. NSPW300BS and NSPW312BS, High Brightness LEDs, Nov. 12, 1999, Publisher: Nichia Corporation.

Press Release from LED Lighting Fixtures dated Apr. 24, 2006 entitled "LED Lighting Fixtures, Inc. achieves unprecedented gain in light output from new luminaire".

Press Release from LED Lighting Fixtures dated Feb. 16, 2006 entitled "LED Lighting Fixtures, Inc. Announces Record Performance".

Press Release from LED Lighting Fixtures dated Feb. 7, 2007 entitled "LED Lighting Fixtures Announces its first LED-based Recessed Down Light".

Press Release from LED Lighting Fixtures dated Jan. 26, 2006 entitled "LED Lighting Fixtures Creates 750 Lumen Recessed Light and Uses Only 16 Watts of Power".

Press Release from LED Lighting Fixtures dated May 30, 2006 entitled "LED Lighting Fixtures, Inc. Sets World Record at 80 Lumens per Watt for Warm White Fixture".

Press Release from LED Lighting Fixtures dated Nov. 28, 2007 entitled "New Lamp from LED Lighting Fixtures Shatter World Record for Energy Efficiency".

Shimizu, "Development of High-Efficiency LED Downlight", First International Conference on White LEDs and Solid State Lighting, Nov. 30, 2007.

Van De Ven et al., "Warm White Illumination with High CRI and High Efficacy by Combining 455 nm Excited Yellowish Phosphor LEDs and Red A1InGaP LEDs," First International Conference on White LEDs and Solid State Lighting, Nov. 30, 2007.

Narendran et al., *Color Rendering Properties of LED Light Sources*, 2002, pp. 1-8.

U.S. Appl. No. 11/613,692, filed Dec. 20, 2006.
U.S. Appl. No. 11/614,180, filed Dec. 21, 2006.
U.S. Appl. No. 11/613,714, filed Dec. 20, 2006.
U.S. Appl. No. 11/624,811, filed Jan. 19, 2007.
U.S. Appl. No. 11/626,483, filed Jan. 24, 2007.
U.S. Appl. No. 11/743,754, filed May 3, 2007.
U.S. Appl. No. 11/751,982, filed May 22, 2007.
U.S. Appl. No. 11/753,103, filed May 24, 2007.
U.S. Appl. No. 11/751,990, filed May 22, 2007.
U.S. Appl. No. 11/736,761, filed Apr. 18, 2007.
U.S. Appl. No. 11/736,799, filed Apr. 18, 2007.
U.S. Appl. No. 11/755,153, filed May 30, 2007.
U.S. Appl. No. 11/755,162, filed May 30, 2007.
U.S. Appl. No. 11/854,744, filed Sep. 13, 2007.
U.S. Appl. No. 11/843,243, filed Aug. 22, 2007.
U.S. Appl. No. 11/870,679, filed Oct. 11, 2007.
U.S. Appl. No. 11/613,714, filed Dec. 20, 2006.
U.S. Appl. No. 12/117,122, filed May 8, 2008.
U.S. Appl. No. 12/117,131, filed May 8, 2008.
U.S. Appl. No. 12/117,136, filed May 8, 2008.
U.S. Appl. No. 11/843,243, filed Aug. 22, 2007.
U.S. Appl. No. 11/947,323, filed Nov. 29, 2007.
U.S. Appl. No. 11/951,626, filed Dec. 6, 2007.
U.S. Appl. No. 12/035,604, filed Feb. 22, 2008.
U.S. Appl. No. 12/117,148, filed May 8, 2008.
U.S. Appl. No. 12/117,271, filed May 8, 2008.
U.S. Appl. No. 11/948,021, filed Nov. 30, 2007.

U.S. Appl. No. 60/978,880, filed Oct. 10, 2007.
U.S. Appl. No. 61/037,365, filed Mar. 18, 2008.
U.S. Appl. No. 60/990,439, filed Nov. 27, 2007.
U.S. Appl. No. 12/057,748, filed Mar. 28, 2008.
U.S. Appl. No. 11/743,324, filed May 2, 2007.
U.S. Appl. No. 11/032,363, filed Jan. 10, 2005.
U.S. Appl. No. 12/248,220, filed Oct. 9, 2008, Van De Ven et al.
U.S. Appl. No. 12/277,745, filed Nov. 25, 2008, Negley et al.
Chhajed, S., *Influence of junction temperature on chromaticity and color-rendering properties of trichromatic white-light sources*. . ., Journal of Applied Physics, Feb. 16, 2005, vol. 97, pp. 1-8.
Color Kinetics Inc., *Color Quality of Intelligent Solid-State Light Systems,* Color Quality of Solid-State Light Sources, Mar. 2005, pp. 1-3.
Cree, Inc., 'Cree® Xlamp® 7090 XR-E Series LED Binning and Labeling,' Application Note: CLD-AP08.000, 7pp (published 2006).
CSA International, 'Test Data Report', Project Number: 1786317, Report Number: 1786317-1 (Apr. 20, 2006).
DOE SSL CALiPer Report, 'Product Test Reference: CALiPER 07-31 Downlight Lamp' Sep. 2007.
DOE SSL CALiPer Report, 'Product Test Reference: CALiPER 07-47 Downlight Lamp', Sep. 2007.
Narendran et al., 'Solid State lighting: failure analysis of white LEDs', Journal of Cystal Growth, vol. 268, Issues 1-4, Aug. 2004, Abstract.
Narendran et al., *Color Rendering Properties of LED Light Sources, published in* 2002, pp. 1-8.
U.S. Department of Energy, 'DOE Solid-State Lighting CALiPER Program, Summary of Results: Round 3 of Product Testing', Oct. 2007.
U.S. Department of Energy, 'DOE Solid-State Lighting CALiPER Program, Summary of Results: Round 4 of Product Testing', Jan. 2008.
U.S. Department of Energy, 'DOE Solid-State Lighting CALiPER Program, Summary of Results: Round 5 of Product Testing', May 2008.
Optoled Lighting Inc., *OptoLED Product Information,* 2009, Publisher: OptoLED GmBH website: accessed at http://222.optoled.de/englisch/products/led.html, 2009.
Permlight Inc., *Enbryten LED Product Information,* Feb. 2005, Publisher: Permlight Inc. website; accessed at http://www.webarchive.org displaying that www.permlight.com/products/LEDfixtures.asp was publicly available Jan. 2004.
Krames et al., *Lumileds lighting, Light from Silicon Valley,* Progress and Future direction of LED Technology, SSL Workshop, Nov. 13, 2003, Publisher: Lumileds Lighting Inc., pp. 1-21.
Van de Ven et al., "Warm White Illumination with High CRI and High Efficacy by Combining 455 nm Excited Yellowish Phosphor LEDs and Red AlInGaP LEDs", First International Conference on White LEDs and Solid State Lighting, Nov. 2007.

LIGHTING DEVICE AND LIGHTING METHOD

CROSS-REFERENCE TO RELATED APPLICATIONS

This application claims the benefit of U.S. Provisional Patent Application No. 60/857,305, filed Nov. 7, 2006, the entirety of which is incorporated herein by reference.

FIELD OF THE INVENTION(S)

The present inventive subject matter relates to a lighting device, in particular, a device which includes one or more solid state light emitters and one or more luminescent materials. The present inventive subject matter is also directed to lighting methods.

BACKGROUND OF THE INVENTION(S)

A large proportion (some estimates are as high as twenty-five percent) of the electricity generated in the United States each year goes to lighting. Accordingly, there is an ongoing need to provide lighting which is more energy-efficient. It is well-known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes (e.g., 10,000-20,000 hours) than incandescent lights, but provide less favorable color reproduction.

Color reproduction is typically measured using the Color Rendering Index (CRI). CRI Ra is a modified average of the relative measurement of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator. Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra).

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on usage of 6 hours per day for 20 years). Light-producing device lifetime is typically much shorter, thus creating the need for periodic change-outs.

Accordingly, for these and other reasons, efforts have been ongoing to develop ways by which light emitting diodes can be used in place of incandescent lights, fluorescent lights and other light-generating devices in a wide variety of applications. In addition, where light emitting diodes are already being used, efforts are ongoing to provide light emitting diodes which are improved, e.g., with respect to energy efficiency, color rendering index (CRI Ra), contrast, efficacy (lm/W), low cost, and/or duration of service.

Light emitting diodes are well-known semiconductor devices that convert electrical current into light. A wide variety of light emitting diodes are used in increasingly diverse fields for an ever-expanding range of purposes.

More specifically, light emitting diodes are semiconducting devices that emit light (ultraviolet, visible, or infrared) when a potential difference is applied across a p-n junction structure. There are a number of well-known ways to make light emitting diodes and many associated structures, and the present inventive subject matter can employ any such devices. By way of example, Chapters 12-14 of Sze, Physics of Semiconductor Devices, (2d Ed. 1981) and Chapter 7 of Sze, Modem Semiconductor Device Physics (1998) describe a variety of photonic devices, including light emitting diodes.

The commonly recognized and commercially available light emitting diode ("LED") that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

As is well-known, a light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

Although the development of light emitting diodes has in many ways revolutionized the lighting industry, some of the characteristics of light emitting diodes have presented challenges, some of which have not yet been fully met. For example, the emission spectrum of any particular light emitting diode is typically concentrated around a single wavelength (as dictated by the light emitting diode's composition and structure), which is desirable for some applications, but not desirable for others, (e.g., for providing lighting, such an emission spectrum provides a very low CRI Ra).

Because light that is perceived as white is necessarily a blend of light of two or more colors (or wavelengths), no single light emitting diode junction has been developed that can produce white light. "White" light emitting diode lamps have been produced which have a light emitting diode pixel/cluster formed of respective red, green and blue light emitting diodes. Other "white" light emitting diode lamps have been produced which include (1) a light emitting diode which generates blue light and (2) a luminescent material (e.g., a phosphor) that emits yellow light in response to excitation by light emitted by the light emitting diode, whereby the blue light and the yellow light, when mixed, produce light that is perceived as white light.

In addition, the blending of primary colors to produce combinations of non-primary colors is generally well understood in this and other arts. In general, the 1931 CIE Chromaticity Diagram (an international standard for primary colors established in 1931), and the 1976 CIE Chromaticity Diagram (similar to the 1931 Diagram but modified such that similar distances on the Diagram represent similar perceived differences in color) provide useful reference for defining colors as weighted sums of primary colors.

Aspects related to the present inventive subject matter can be represented on either the 1931 CIE (Commission International de l'Eclairage) Chromaticity Diagram or the 1976 CIE Chromaticity Diagram. FIG. 1 shows the 1931 CIE Chromaticity Diagram. FIG. 2 shows the 1976 Chromaticity Diagram. FIG. 3 shows an enlarged portion of the 1976 Chromaticity Diagram, in order to show the blackbody locus in more detail. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). For a technical description of CIE chromaticity diagrams, see, for example, "Encyclopedia of Physical Science and Technology", vol. 7, 230-231 (Robert A Meyers ed., 1987). The spectral colors are distributed around the edge of the outlined space, which includes all of the hues perceived by the human eye. The boundary line represents maximum saturation for the spectral colors. As noted above, the 1976 CIE Chromaticity Diagram is similar to the 1931 Diagram, except that the 1976 Diagram has been modified such that similar distances on the Diagram represent similar perceived differences in color.

In the 1931 Diagram, deviation from a point on the Diagram can be expressed either in terms of the coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues which would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$, and the hues defined by a locus of points which are each a common distance from a specified hue consist of hues which would each be perceived as differing from the specified hue to a common extent.

The chromaticity coordinates and the CIE chromaticity diagrams illustrated in FIGS. 1-3 are explained in detail in a number of books and other publications, such as pages 98-107 of K. H. Butler, "Fluorescent Lamp Phosphors" (The Pennsylvania State University Press 1980) and pages 109-110 of G. Blasse et al., "Luminescent Materials" (Springer-Verlag 1994), both incorporated herein by reference.

The chromaticity coordinates (i.e., color points) that lie along the blackbody locus obey Planck's equation: $E(\lambda)=A\lambda^{-5}/(e^{(B/T)}-1)$, where E is the emission intensity, $\lambda$ is the emission wavelength, T the color temperature of the blackbody and A and B are constants. Color coordinates that lie on or near the blackbody locus yield pleasing white light to a human observer. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants which produce light which is on or near the blackbody locus can thus be described in terms of their color temperature.

Also depicted on the 1976 CIE Diagram are designations A, B, C, D and E, which refer to light produced by several standard illuminants correspondingly identified as illuminants A, B, C, D and E, respectively.

Light emitting diodes can thus be used individually or in any combinations, optionally together with one or more luminescent material (e.g., phosphors or scintillators) and/or filters, to generate light of any desired perceived color (including white). Accordingly, the areas in which efforts are being made to replace existing light sources with light emitting diode light sources, e.g., to improve energy efficiency, color rendering index (CRI Ra), efficacy (lm/W), and/or duration of service, are not limited to any particular color or color blends of light.

A wide variety of luminescent materials are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light. The expression "lumiphor", as used herein, refers to any luminescent element, i.e., any element which includes a luminescent material.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished by adding the luminescent materials to a clear or translucent encapsulant material (e.g., epoxy-based, silicone-based, glass-based or metal oxide-based material) as discussed above, for example by a blending or coating process.

For example, U.S. Pat. No. 6,963,166 (Yano '166) discloses that a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. According to Yano '166, the first resin portion is obtained by filling the cup reflector with a resin material and curing it after the light emitting diode chip has been mounted onto the bottom of the cup reflector and then has had its cathode and anode electrodes electrically connected to the leads by way of wires. According to Yano '166, a phosphor is dispersed in the first resin portion so as to be excited with the light A that has been emitted from the light emitting diode chip, the excited phosphor produces fluorescence ("light B") that has a longer wavelength than the light A, a portion of the light A is transmitted through the first resin portion including the phosphor, and as a result, light C, as a mixture of the light A and light B, is used as illumination.

As noted above, "white LED lamps" (i.e., lamps which emit light which is perceived as being white or near-white) have been investigated as potential replacements for white incandescent lamps. A representative example of a white LED lamp includes a package of a blue light emitting diode chip, made of indium gallium nitride (InGaN) or gallium nitride (GaN), coated with a phosphor such as YAG. In such an LED lamp, the blue light emitting diode chip produces an emission with a wavelength of about 450 nm, and the phosphor produces yellow fluorescence with a peak wavelength of about 550 nm on receiving that emission. For instance, in some designs, white light emitting diode lamps are fabricated by forming a ceramic phosphor layer on the output surface of a blue light-emitting semiconductor light emitting diode. Part of the blue ray emitted from the light emitting diode chip passes through the phosphor, while part of the blue ray emitted from the light emitting diode chip is absorbed by the phosphor, which becomes excited and emits a yellow ray. The part of the blue light emitted by the light emitting diode which is transmitted through the phosphor is mixed with the yellow light emitted by the phosphor. The viewer perceives the mixture of blue and yellow light as white light. Another type uses a blue or violet light emitting diode chip which is combined with phosphor materials that produce red or orange and green or yellowish-green light rays. In such a lamp, part of the blue or violet light emitted by the light emitting diode chip excites the phosphors, causing the phosphors to emit red or orange and yellow or green light rays. These rays, combined with the blue or violet rays, can produce the perception of white light.

As also noted above, in another type of LED lamp, a light emitting diode chip that emits an ultraviolet ray is combined with phosphor materials that produce red (R), green (G) and blue (B) light rays. In such an "RGB LED lamp", the ultraviolet ray that has been radiated from the light emitting diode chip excites the phosphor, causing the phosphor to emit red, green and blue light rays which, when mixed, are perceived by the human eye as white light. Consequently, white light can also be obtained as a mixture of these light rays.

Designs have been provided in which existing LED component packages and other electronics are assembled into a fixture. In such designs, a packaged LED is mounted to a circuit board (or directly to a heat sink), the circuit board is mounted to a heat sink, and the heat sink is mounted to the fixture housing along with required drive electronics. In many cases, additional optics (secondary to the package parts) are also necessary.

In substituting light emitting diodes for other light sources, e.g., incandescent light bulbs, packaged LEDs have been used with conventional light fixtures, for example, fixtures which include a hollow lens and a base plate attached to the lens, the base plate having a conventional socket housing with one or more contacts which are electrically coupled to a power source. For example, LED light bulbs have been constructed which comprise an electrical circuit board, a plurality of packaged LEDs mounted to the circuit board, and a connection post attached to the circuit board and adapted to be connected to the socket housing of the light fixture, whereby the plurality of LEDs can be illuminated by the power source.

There is an ongoing need for ways to use solid state light emitters, e.g., light emitting diodes, to provide light with greater energy efficiency and with acceptable color rendering index (CRI Ra).

BRIEF SUMMARY OF THE INVENTION(S)

The present inventors have designed light emitters, light engines and lighting devices which comprise one or more LEDs and one or more luminescent materials and which provide very high CRI Ra along with excellent efficacy, for example, as disclosed in:

(1) U.S. Patent Application No. 60/752,555, filed Dec. 21, 2005, entitled "Lighting Device and Lighting Method" (inventors: Antony Paul Van de Ven and Gerald H. Negley), the entirety of which is hereby incorporated by reference;

(2) U.S. Patent Application No. 60/793,524, filed on Apr. 20, 2006, entitled "LIGHTING DEVICE AND LIGHTING METHOD" (inventors: Gerald H. Negley and Antony Paul van de Ven), the entirety of which is hereby incorporated by reference;

(3) U.S. Patent Application No. 60/793,518, filed on Apr. 20, 2006, entitled "LIGHTING DEVICE AND LIGHTING METHOD" (inventors: Gerald H. Negley and Antony Paul van de Ven), the entirety of which is hereby incorporated by reference; and (4) U.S. Patent Application No. 60/809,618, filed on May 31, 2006, entitled "LIGHTING DEVICE AND METHOD OF LIGHTING" (inventors: Gerald H. Negley, Antony Paul van de Ven and Thomas G. Coleman), the entirety of which is hereby incorporated by reference.

There are many situations where lighting is required, but where such high CRI Ra is not required. In these situations, as in any other situation, higher efficacy is always desired.

The present inventive subject matter provides lighting devices which provide outstanding efficacy as well as good CRI Ra (i.e., some CRI Ra is sacrificed to provide better efficacy). The present inventive subject matter also provides lighting devices which can be used along with additional lighting devices (e.g., saturated and/or broad spectrum lighting devices) to provide lighting, e.g., to emit mixed light having x, y color coordinates on or near the blackbody locus.

In a first aspect of the present inventive subject matter, there is provided a lighting device comprising a first group of solid state light emitters and a first group of lumiphors. In this first aspect of the present inventive subject matter, if each of the first group of solid state light emitters is illuminated and each of the first group of lumiphors is excited, a mixture of light emitted from the first group of solid state light emitters and the first group of lumiphors would, in the absence of any additional light, have a first group mixed illumination having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.32, 0.40, the second point having x, y coordinates of 0.36, 0.38, the third point having x, y coordinates of 0.41, 0.455, and the fourth point having x, y coordinates of 0.36, 0.48.

The expression "group of solid state light emitters", as used herein (above and in the pages that follow) means, that the group includes one or more solid state light emitter(s). The expression "group of lumiphors", as used herein, means that the group includes one or more lumiphor. For example, the first aspect of the present invention encompasses a lighting device which includes a single solid state light emitter and a single lumiphor.

In a second aspect of the present inventive subject matter, there is provided a lighting device comprising a first group of solid state light emitters and a first group of lumiphors. In this second aspect of the present inventive subject matter, if each of the first group of solid state light emitters is illuminated and each of the first group of lumiphors is excited, a mixture of light emitted from the first group of solid state light emitters and the first group of lumiphors would, in the absence of any additional light, have a first group mixed illumination having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.36, 0.48, the second point having x, y coordinates of 0.43, 0.45, the third point having x, y coordinates of 0.5125, 0.4866, and the fourth point having x, y coordinates of 0.4087, 0.5896.

In a third aspect of the present inventive subject matter, there is provided a lighting device comprising a first group of solid state light emitters and a first group of lumiphors. In this third aspect of the present inventive subject matter, if each of the first group of solid state light emitters is illuminated and each of the first group of lumiphors is excited, a mixture of light emitted from the first group of solid state light emitters and the first group of lumiphors would, in the absence of any additional light, have a first group mixed illumination having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.41, 0.455 the second point having x, y coordinates of 0.36, 0.48, the third point having x,y coordinates of 0.4087, 0.5896, and the fourth point having x, y coordinates of 0.4788, 0.5202.

In a fourth aspect of the present inventive subject matter, there is provided a lighting device comprising a first group of solid state light emitters, a first group of lumiphors, a second group of solid state light emitters and a second group of lumiphors. In this fourth aspect of the present inventive subject matter:

if each of the first group of solid state light emitters is illuminated and each of the first group of lumiphors is excited, a mixture of light emitted from the first group of solid state light emitters and the first group of lumiphors would, in the absence of any additional light, have a first group mixed illumination having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, and the fourth line segment connecting the fourth point to the first point, the first point having x, y coordinates of 0.36, 0.48, the second point having x, y coordinates of 0.43, 0.45, the third point having x, y coordinates of 0.5125, 0.4866, and the fourth point having x, y coordinates of 0.4087, 0.5896;

if each of the second group of solid state light emitters is illuminated and each of the second group of lumiphors is excited, a mixture of light emitted from the second group of solid state light emitters and the second group of lumiphors would, in the absence of any additional light, have a second group mixed illumination having x, y color coordinates which define a point which is within an area on a 1931 CIE Chromaticity Diagram enclosed by fifth, sixth, seventh and eighth line segments, the fifth line segment connecting a fifth point to a sixth point, the sixth line segment connecting the sixth point to a seventh point, the seventh line segment connecting the seventh point to an eighth point, and the eighth line segment connecting the eighth point to the fifth point, the fifth point having x, y coordinates of 0.32, 0.40, the sixth point having x, y coordinates of 0.36, 0.38, the seventh point having x, y coordinates of 0.30, 0.26, and the eighth point having x, y coordinates of 0.25, 0.29; and each of the first group of solid state light emitters and the second group of solid state light emitters is illuminated and each of the first group of lumiphors and the second group of lumiphors is excited, a mixture of light emitted from the first group of solid state light emitters, the second group of solid state light emitters, the first group of lumiphors and the second group of lumiphors would, in the absence of any additional light, have a first group-second group mixed illumination having x, y color coordinates which define a point which is within an area on a 1931 CIE Chromaticity Diagram enclosed by ninth, tenth, eleventh, twelfth and thirteenth line segments, the ninth line segment connecting a ninth point to a tenth point, the tenth line segment connecting the tenth point to an eleventh point, the eleventh line segment connecting the eleventh point to a twelfth point, the twelfth line segment connecting the twelfth point to a thirteenth point, and the thirteenth line segment connecting the thirteenth point to the ninth point, the ninth point having x, y coordinates of 0.32, 0.40, the tenth point having x, y coordinates of 0.36, 0.48, the eleventh point having x, y coordinates of 0.43, 0.45, the twelfth point having x, y coordinates of 0.42, 0.42, and the thirteenth point having x, y coordinates of 0.36, 0.38.

In a fifth aspect of the present inventive subject matter, there is provided a lighting device comprising a first group of solid state light emitters, a first group of lumiphors, a second group of solid state light emitters and a second group of lumiphors. In this fifth aspect of the present inventive subject matter:

if each of the first group of solid state light emitters is illuminated and each of the first group of lumiphors is excited, a mixture of light emitted from the first group of solid state light emitters and the first group of lumiphors would, in the absence of any additional light, have a first group mixed illumination having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, and the fourth line segment connecting the fourth point to the first point, the first point having x, y coordinates of 0.41, 0.455 the second point having x, y coordinates of 0.36, 0.48, the third point having x, y coordinates of 0.4087, 0.5896, and the fourth point having x, y coordinates of 0.4788, 0.5202;

if each of the second group of solid state light emitters is illuminated and each of the second group of lumiphors is excited, a mixture of light emitted from the second group of solid state light emitters and the second group of lumiphors would, in the absence of any additional light, have a second group mixed illumination having x, y color coordinates which define a point which is within an area on a 1931 CIE Chromaticity Diagram enclosed by fifth, sixth, seventh and eighth line segments, the fifth line segment connecting a fifth point to a sixth point, the sixth line segment connecting the sixth point to a seventh point, the seventh line segment connecting the seventh point to an eighth point, and the eighth line segment connecting the eighth point to the fifth point, the fifth point having x, y coordinates of 0.32, 0.40, the sixth point having x, y coordinates of 0.36, 0.38, the seventh point having x, y coordinates of 0.25, 0.29, and the eighth point having x, y coordinates of 0.30, 0.26;

if each of the first group of solid state light emitters and the second group of solid state light emitters is illuminated and each of the first group of lumiphors and the second group of lumiphors is excited, a mixture of light emitted from the first group of solid state light emitters, the second group of solid state light emitters, the first group of lumiphors and the second group of lumiphors would, in the absence of any additional light, have a first group-second group mixed illumination having x, y color coordinates which define a point which is within an area on a 1931 CIE Chromaticity Diagram enclosed by ninth, tenth, eleventh and twelfth line segments, the ninth line segment connecting a ninth point to a tenth point, the tenth line segment connecting the tenth point to an eleventh point, the eleventh line segment connecting the eleventh point to a twelfth point, the twelfth line segment connecting the twelfth point to the ninth point, the ninth point having x, y coordinates of 0.32, 0.40, the tenth point having x, y coordinates of 0.36, 0.38, the eleventh point having x, y coordinates of 0.41, 0.455, and the twelfth point having x, y coordinates of 0.36, 0.48.

In a sixth aspect of the present inventive subject matter, there is provided a method of lighting, comprising:

mixing light from a first group of at least one solid state light emitter and light from a first group of at least one lumiphor to form first group mixed illumination, where:

the first group mixed illumination has x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.32, 0.40, the second point having x, y coordinates of 0.36, 0.38, the third point having x, y coordinates of 0.41, 0.455, and the fourth point having x, y coordinates of 0.36, 0.48.

In a seventh aspect of the present inventive subject matter, there is provided a method of lighting, comprising:

mixing light from a first group of at least one solid state light emitter and light from a first group of at least one lumiphor to form first group mixed illumination, where:

the first group mixed illumination has x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.36, 0.48, the second point having x, y coordinates of 0.43, 0.45, the third point having x, y coordinates of 0.5125, 0.4866, and the fourth point having x, y coordinates of 0.4087, 0.5896.

In an eighth aspect of the present inventive subject matter, there is provided a method of lighting, comprising:

mixing light from a first group of at least one solid state light emitter and light from a first group of at least one lumiphor to form first group mixed illumination, where:

the first group mixed illumination has x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.41, 0.455 the second point having x, y coordinates of 0.36, 0.48, the third point having x, y coordinates of 0.4087, 0.5896, and the fourth point having x, y coordinates of 0.4788, 0.5202.

In a ninth aspect of the present inventive subject matter, there is provided a method of lighting, comprising:

mixing light from a first group of at least one solid state light emitter, light from a second group of at least one solid state light emitter, light from a first group of at least one lumiphor and light from a second group of at least one lumiphor to form first group-second group mixed illumination, where:

the first group-second group mixed illumination has x, y color coordinates which define a point which is within an area on a 1931 CIE Chromaticity Diagram enclosed by ninth, tenth, eleventh, twelfth and thirteenth line segments, the ninth line segment connecting a ninth point to a tenth point, the tenth line segment connecting the tenth point to an eleventh point, the eleventh line segment connecting the eleventh point to a twelfth point, the twelfth line segment connecting the twelfth point to a thirteenth point, and the thirteenth line segment connecting the thirteenth point to the ninth point, the ninth point having x, y coordinates of 0.32, 0.40, the tenth point having x, y coordinates of 0.36, 0.48, the eleventh point having x, y coordinates of 0.43, 0.45, the twelfth point having x, y coordinates of 0.42, 0.42, and the thirteenth point having x, y coordinates of 0.36, 0.38, a mixture of light emitted from the first group of solid state light emitters and the first group of lumiphors would, in the absence of any additional light, have a first group mixed illumination having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, and the fourth line segment connecting the fourth point to the first point, the first point having x, y coordinates of 0.36, 0.48, the second point having x, y coordinates of 0.43, 0.45, the third point having x, y coordinates of 0.5125, 0.4866, and the fourth point having x, y coordinates of 0.4087, 0.5896, and a mixture of light emitted from the second group of solid state light emitters and the second group of lumiphors would, in the absence of any additional light, have a second group mixed illumination having x, y color coordinates which define a point which is within an area on a 1931 CIE Chromaticity Diagram enclosed by fifth, sixth, seventh and eighth line segments, the fifth line segment connecting a fifth point to a sixth point, the sixth line segment connecting the sixth point to a seventh point, the seventh line segment connecting the seventh point to an eighth point, and the eighth line segment connecting the eighth point to the fifth point, the fifth point having x, y coordinates of 0.32, 0.40, the sixth point having x, y coordinates of 0.36, 0.38, the seventh point having x, y coordinates of 0.30, 0.26, and the eighth point having x, y coordinates of 0.25, 0.29.

In a tenth aspect of the present inventive subject matter, there is provided a method of lighting, comprising:

mixing light from a first group of at least one solid state light emitter, light from a second group of at least one solid state light emitter, light from a first group of at least one lumiphor and light from a second group of at least one lumiphor to form first group-second group mixed illumination, where:

the first group-second group mixed illumination has x, y color coordinates which define a point which is within an area on a 1931 CIE Chromaticity Diagram enclosed by ninth, tenth, eleventh and twelfth line segments, the ninth line segment connecting a ninth point to a tenth point, the tenth line segment connecting the tenth point to an eleventh point, the eleventh line segment connecting the eleventh point to a twelfth point, the twelfth line segment connecting the twelfth point to the ninth point, the ninth point having x, y coordinates of 0.32, 0.40, the tenth point having x, y coordinates of 0.36, 0.38, the eleventh point having x, y coordinates of 0.41, 0.455, and the twelfth point having x, y coordinates of 0.36, 0.48, a mixture of light emitted from the first group of solid state light emitters and the first group of lumiphors would, in the absence of any additional light, have a first group mixed illumination having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, and the fourth line segment connecting the fourth point to the first point, the first point having x, y coordinates of 0.41, 0.455 the second point having x, y coordinates of 0.36, 0.48, the third point having x, y coordinates of 0.4087, 0.5896, and the fourth point having x, y coordinates of 0.4788, 0.5202, and a mixture of light emitted from the second group of solid state light emitters and the second group of lumiphors would, in the absence of any additional light, have a second group mixed illumination having x, y color coordinates which define a point which is within an area on a 1931 CIE Chromaticity Diagram enclosed by fifth, sixth, seventh and eighth line segments, the fifth line segment connecting a fifth point to a sixth point, the sixth line segment connecting the sixth point to a seventh point, the seventh line segment connecting the seventh point to an eighth point, and the eighth line segment connecting the eighth point to the fifth point, the fifth point having x, y coordinates of 0.32, 0.40, the sixth point having x, y coordinates of 0.36, 0.38, the seventh point having x, y coordinates of 0.30, 0.26, and the eighth point having x, y coordinates of 0.25, 0.29.

In some embodiments according to the present inventive subject matter:

each of the first group of solid state light emitters, if illuminated, would emit light having a peak wavelength in the range of from 430 nm to 480 nm; and each of the first group of lumiphors, if excited, would emit light having a dominant wavelength in the range of from about 555 nm to about 585 nm.

In some embodiments according to the present inventive subject matter, if every LED in the lighting device is illuminated, the lighting device would emit light:

having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to the fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38 (and in some cases, enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.32, 0.40, the second point having x, y coordinates of 0.36, 0.38, the third point having x, y coordinates of 0.41, 0.455, and the fourth point having x, y coordinates of 0.36, 0.48);

having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.41, 0.455 said second point having x, y coordinates of 0.36, 0.48, said third point having x, y coordinates of 0.4087, 0.5896, and said fourth point having x, y coordinates of 0.4788, 0.5202; or having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.36, 0.48, the second point having x, y coordinates of 0.43, 0.45, the third point having x, y coordinates of 0.5125, 0.4866, and the fourth point having x, y coordinates of 0.4087, 0.5896.

In some embodiments according to the first aspect, the fifth aspect, the sixth aspect or the tenth aspect of the present inventive subject matter, the lighting device further comprises at least one power line, and if power is supplied to each of the at least one power line, the lighting device would emit light having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.32, 0.40, the second point having x, y coordinates of 0.36, 0.38, the third point having x, y coordinates of 0.41, 0.455, and the fourth point having x, y coordinates of 0.36, 0.48.

In some embodiments according to the fourth aspect or the ninth aspect of the present inventive subject matter, the lighting device further comprises at least one power line, and if power is supplied to each of the at least one power line, the lighting device would emit light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to the fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

In some embodiments according to the third aspect or the eighth aspect of the present inventive subject matter, the lighting device further comprises at least one power line, and if power is supplied to each of the at least one power line, the lighting device would emit light having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.41, 0.455 said second point having x, y coordinates of 0.36, 0.48, said third point having x, y coordinates of 0.4087, 0.5896, and said fourth point having x, y coordinates of 0.4788, 0.5202.

In some embodiments according to the second aspect or the seventh aspect of the present inventive subject matter, the lighting device further comprises at least one power line, and if power is supplied to each of the at least one power line, the lighting device would emit light having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.36, 0.48, the second point having x, y coordinates of 0.43, 0.45, the third point having x, y coordinates of 0.5125, 0.4866, and the fourth point having x, y coordinates of 0.4087, 0.5896.

In some embodiments according to the present inventive subject matter, the lighting device further comprises an additional group of solid state light emitters comprising at least one solid state light emitter which, if illuminated, would emit light having a dominant wavelength in the range of from 600 nm to 630 nm. In some such embodiments, the lighting device further comprises a further group of solid state light emitters comprising at least one solid state light emitter which, if illuminated, would emit light having a dominant wavelength in the range of from 495 nm to 510 nm.

In some embodiments according to the present inventive subject matter, the lighting device further comprises an additional group of solid state light emitters comprising at least one solid state light emitter which, if illuminated, would emit saturated light.

In some embodiments according to the present inventive subject matter, the lighting device, when supplied with electricity of a first wattage, emits output light of an efficacy of at least 60 lumens per watt (in some embodiments at least 70 lumens per watt, and in some embodiments, at least 80 lumens per watt) of the electricity. In some such embodiments, the output light is of a brightness of at least 300 lumens, in some embodiments at least 500 lumens.

In some embodiments according to first aspect or the sixth aspect of the present inventive subject matter, the first group mixed illumination has x, y color coordinates on a 1931 CIE Chromaticity Diagram which are also at least a distance of 0.03 (in some embodiments, at least a distance of 0.045) from any point on the blackbody locus.

In some embodiments according to fourth aspect, the fifth aspect, the ninth aspect or the tenth aspect of the present inventive subject matter, the first group-second group mixed illumination has x, y color coordinates on a 1931 CIE Chromaticity Diagram which are also at least a distance of 0.03 (in some embodiments, at least a distance of 0.045) from any point on the blackbody locus.

In some embodiments according to the first aspect, the second aspect, the third aspect, the sixth aspect, the seventh aspect and the eighth aspect of the present inventive subject matter, the first group mixed illumination has a CRI Ra of at least 40, in some embodiments, at least 50, and in some embodiments, at least 55.

In some embodiments according to the fourth aspect, the fifth aspect, the ninth aspect and the tenth aspect of the present inventive subject matter, the first group-second group mixed illumination has a CRI Ra of at least 40, in some embodiments, at least 50, and in some embodiments, at least 55.

In some embodiments according to the first aspect, the second aspect, the third aspect, the sixth aspect, the seventh aspect and the eighth aspect of the present inventive subject matter, the first group of solid state light emitters comprises all of the solid state light emitters in the lighting device which, if illuminated, would emit light having a peak wavelength in the range of from about 430 nm to about 480 nm, and the first group of lumiphors comprises all of the lumiphors in the lighting device which, if excited, would emit light having a dominant wavelength in the range of from about 555 nm to about 585 nm.

In some embodiments according to the fourth aspect, the fifth aspect, the ninth aspect and the tenth aspect of the present inventive subject matter, the first and second groups of solid state light emitters together comprise all of the solid state light emitters in the lighting device which, if illuminated, would emit light having a peak wavelength in the range of from about 430 nm to about 480 nm, and the first and second groups of lumiphors together comprise all of the lumiphors in the lighting device which, if excited, would emit light having a dominant wavelength in the range of from about 555 nm to about 585 nm.

In some embodiments according to the first aspect, the second aspect, the third aspect, the sixth aspect, the seventh aspect and the eighth aspect of the present inventive subject matter, the lighting device further comprises at least one power line, and the first group of solid state light emitters comprises all solid state light emitters which are directly or switchably electrically connected to the at least one power line and which, if illuminated, would emit light having a peak wavelength in the range of from 430 nm to 480 nm.

In some embodiments according to the fourth aspect, the fifth aspect, the ninth aspect and the tenth aspect of the present inventive subject matter, the lighting device further comprises at least one power line, and the first and second groups of solid state light emitters together comprise all solid state light emitters which are directly or switchably electrically connected to the at least one power line and which, if illuminated, would emit light having a peak wavelength in the range of from 430 nm to 480 nm.

In some embodiments according to the first aspect, the second aspect, the third aspect, the sixth aspect, the seventh aspect and the eighth aspect of the present inventive subject matter, the first group of lumiphors comprises all lumiphors which are illuminated if power is supplied to the at least one power line, and each of the lumiphors in the first and second groups of lumiphors is illuminated if power is supplied to the at least one power line.

In some embodiments according to the fourth aspect, the fifth aspect, the ninth aspect and the tenth aspect of the present inventive subject matter, the first and second groups of lumiphors together comprise all lumiphors which are illuminated if power is supplied to the at least one power line, and each of the lumiphors in the first and second groups of lumiphors is illuminated if power is supplied to the at least one power line.

In some embodiments according to the first aspect, the second aspect, the third aspect, the sixth aspect, the seventh aspect and the eighth aspect of the present inventive subject matter, if all of the solid state light emitters in the first group of solid state light emitters are illuminated, each of the lumiphors in the first group of lumiphors would be excited by light emitted from at least one of the solid state light emitters.

In some embodiments according to the fourth aspect, the fifth aspect, the ninth aspect and the tenth aspect of the present inventive subject matter, if all of the solid state light emitters in the first and second groups of solid state light emitters are illuminated, each of the lumiphors in the first and second groups of lumiphors would be excited by light emitted from at least one of the solid state light emitters.

In some embodiments according to the first aspect, the second aspect, the third aspect, the sixth aspect, the seventh aspect and the eighth aspect of the present inventive subject matter, each of the solid state light emitters in the first group of solid state light emitters is embedded within an encapsulant element in which at least one of the first group of lumiphors is also embedded.

In some embodiments according to the fourth aspect, the fifth aspect, the ninth aspect and the tenth aspect of the present inventive subject matter, each of the solid state light emitters in the first and second groups of solid state light emitters is embedded within an encapsulant element in which at least one of the first and second groups of lumiphors is also embedded.

In some embodiments according to the first aspect, the second aspect, the third aspect, the sixth aspect, the seventh aspect and the eighth aspect of the present inventive subject matter, the first group of solid state light emitters comprises at least five solid state light emitters, and the first group of lumiphors comprises at least five lumiphors.

In some embodiments according to the fourth aspect, the fifth aspect, the ninth aspect and the tenth aspect of the present inventive subject matter, the first and second groups of solid state light emitters together comprise at least five solid state light emitters, and the first and second groups of lumiphors together comprise at least five lumiphors.

In some embodiments according to the first aspect, the second aspect, the third aspect, the sixth aspect, the seventh aspect and the eighth aspect of the present inventive subject matter, the first group of solid state light emitters comprises at least ten solid state light emitters, and the first group of lumiphors comprises at least ten lumiphors.

In some embodiments according to the fourth aspect, the fifth aspect, the ninth aspect and the tenth aspect of the present inventive subject matter, the first and second groups of solid state light emitters together comprise at least ten solid state light emitters, and the first and second groups of lumiphors together comprise at least ten lumiphors.

In some embodiments according to the first aspect, the second aspect, the third aspect, the sixth aspect, the seventh aspect and the eighth aspect of the present inventive subject matter, the first group of solid state light emitters comprises at least twenty-five solid state light emitters, and the first group of lumiphors comprises at least twenty-five lumiphors.

In some embodiments according to the fourth aspect, the fifth aspect, the ninth aspect and the tenth aspect of the present inventive subject matter, the first and second groups of solid state light emitters together comprise at least twenty-five solid state light emitters, and the first and second groups of lumiphors together comprise at least twenty-five lumiphors.

In a further aspect, the present inventive subject matter is directed to an enclosure, comprising an enclosed space and at least one lighting device as described above, wherein if the lighting device is illuminated, the lighting device would illuminate at least a portion of the enclosure.

In a further aspect, the present inventive subject matter is directed to a lighting element, comprising a surface and at least one lighting device as described above, wherein if the lighting device is illuminated, the lighting device would illuminate at least a portion of the surface.

In a further aspect, the present inventive subject matter is directed to a device for which lighting is required, but for which high CRI Ra is not necessarily required, and which device includes a lighting device as described herein. Representative examples of such devices include motion sensors, mobile phones, signage, flashing lights, doorbell indicators, emergency lighting, auxiliary lighting, outdoor illumination, emergency egress lighting, and backlights (e.g., in toys, mobile phones, etc.). In a specific aspect of the inventive subject matter in relation to emergency egress lighting, the light is illuminated in response to the occurrence of the emergency event (e.g., a fire alarm being pulled, a smoke alarm being triggered), and if no motion is detected for a certain period of time (which can be selectable), e.g., five minutes, the light is automatically turned off (and turned back on if motion is again detected).

In a further aspect, the present inventive subject matter is directed to a light fixture comprising at least one lighting device as described above.

BRIEF DESCRIPTION OF THE DRAWING FIGURES

DETAILED DESCRIPTION OF THE INVENTION(S)

Figure 1:
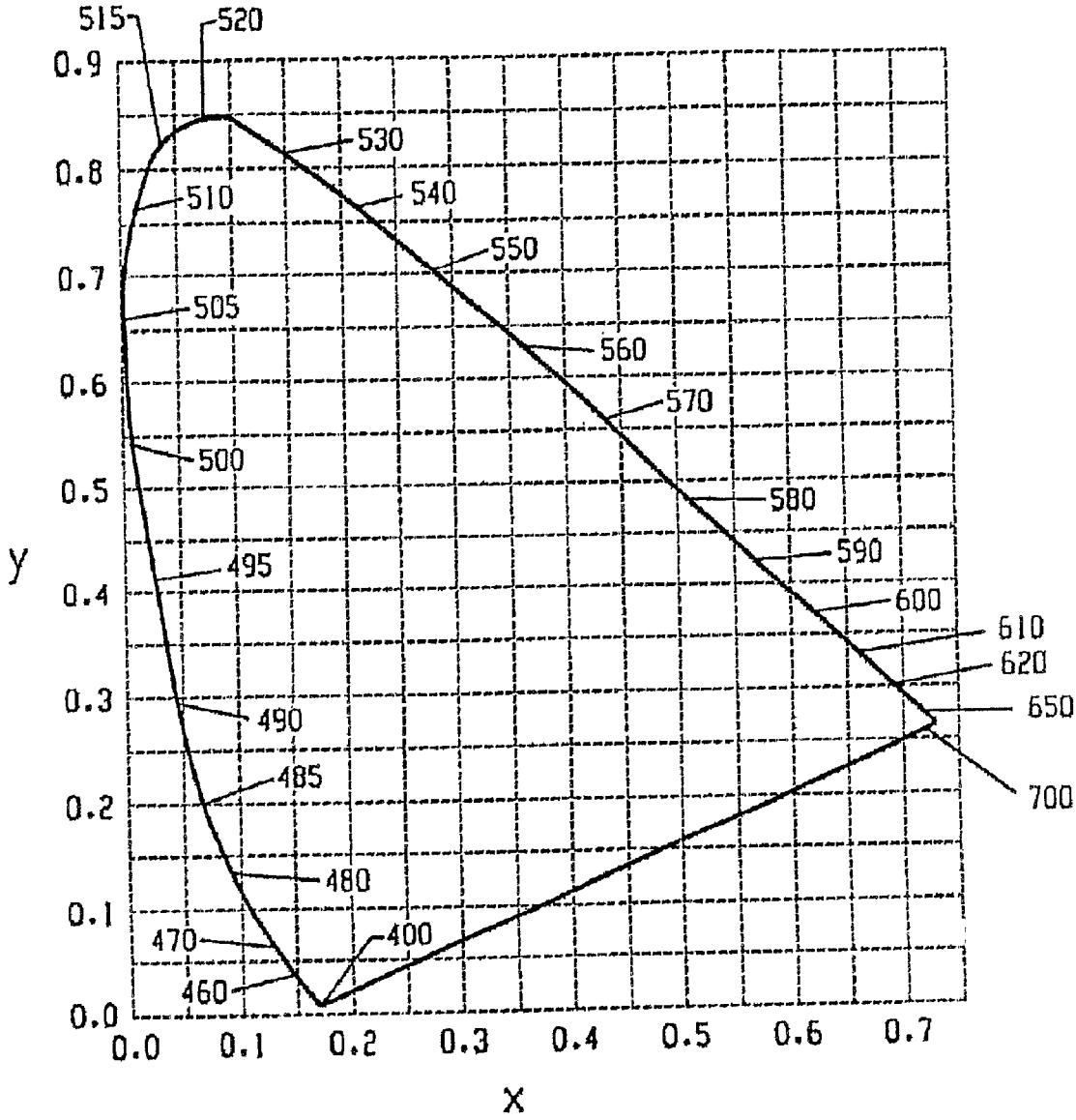
FIG. 1 shows the 1931 CIE Chromaticity Diagram.
Figure 2:
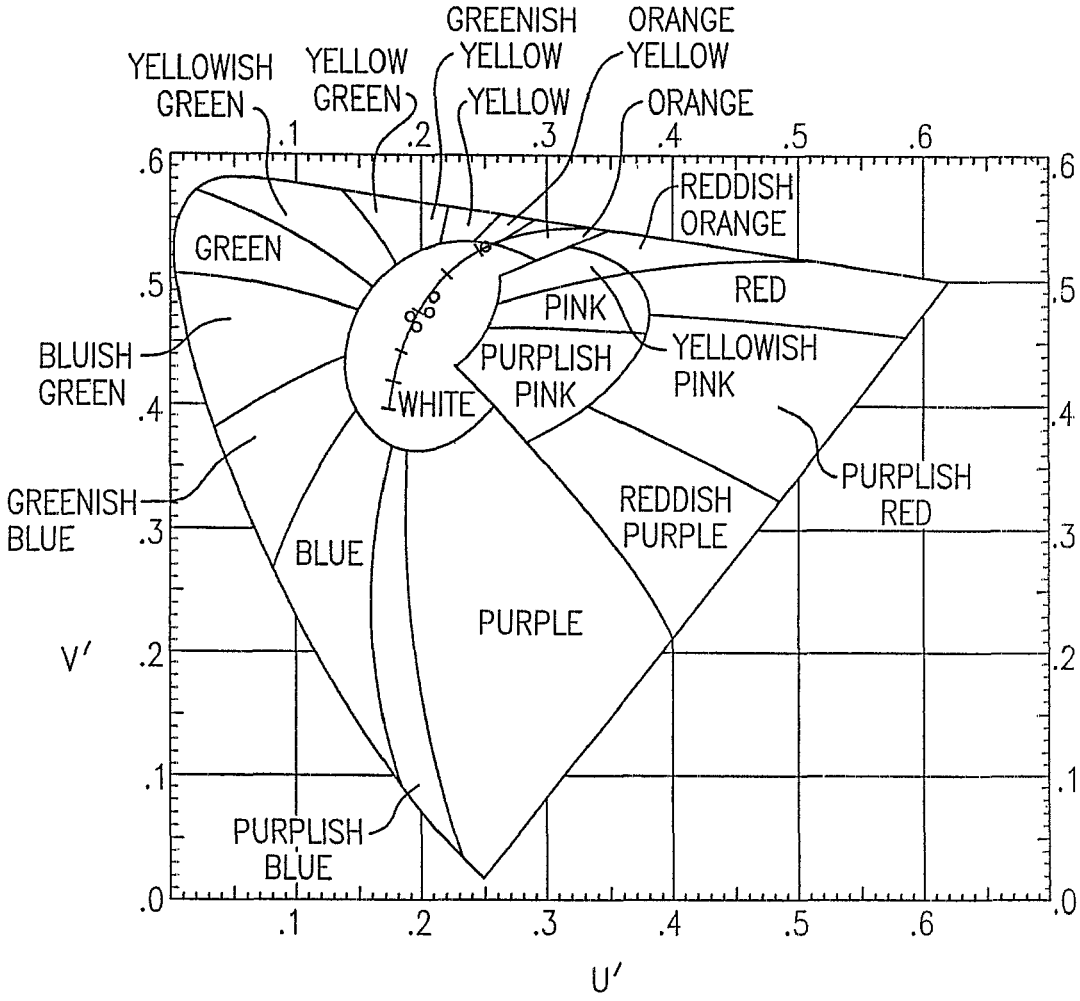
FIG. 2 shows the 1976 Chromaticity Diagram.
Figure 3:
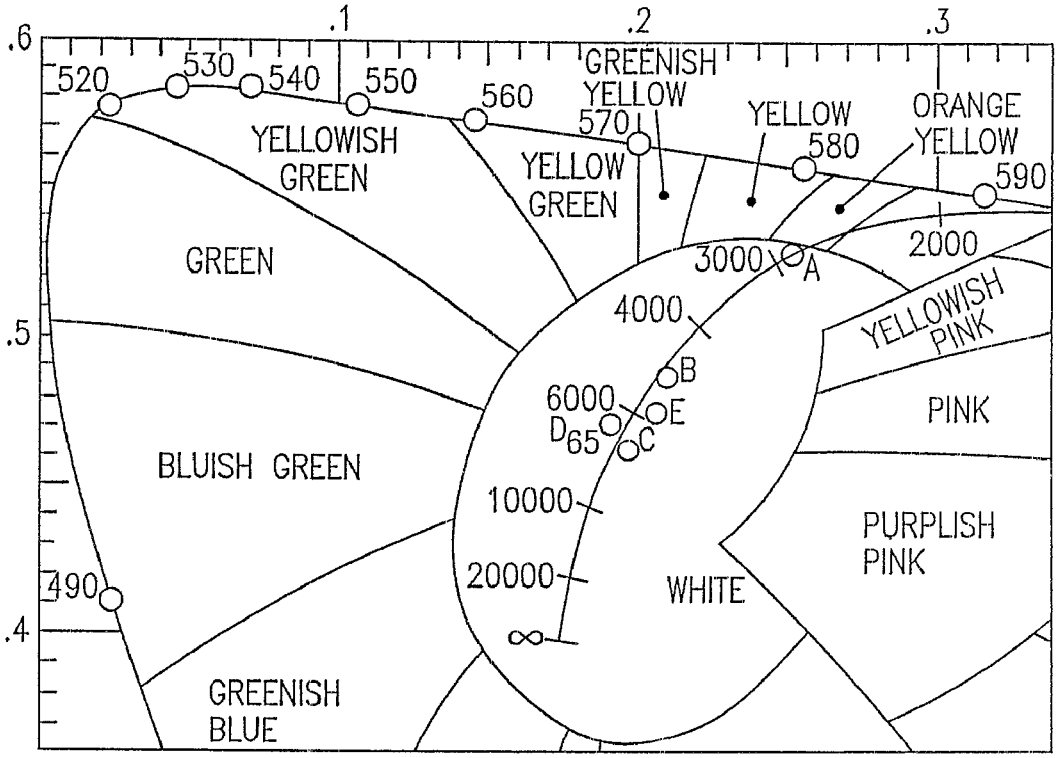
FIG. 3 shows an enlarged portion of the 1976 Chromaticity Diagram, in order to show the blackbody locus in detail.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Furthermore, relative terms, such as "lower" or "bottom" and "upper" or "top," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "illumination" (or "illuminated"), as used herein when referring to a solid state light emitter, means that at least some current is being supplied to the solid state light emitter to cause the solid state light emitter to emit at least some light. The expression "illuminated" encompasses situations where the solid state light emitter emits light continuously or intermittently at a rate such that a human eye would perceive it as emitting light continuously, or where a plurality of solid state light emitters of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "excited", as used herein when referring to a lumiphor, means that at least some electromagnetic radiation (e.g., visible light, UV light or infrared light) is contacting the lumiphor, causing the lumiphor to emit at least some light. The expression "excited" encompasses situations where the lumiphor emits light continuously or intermittently at a rate such that a human eye would perceive it as emitting light continuously, or where a plurality of lumiphors of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "saturated", as used herein, means having a purity of at least 85%, the term "purity" having a well-known meaning to persons skilled in the art, and procedures for calculating purity being well-known to those of skill in the art.

The expression "lighting device", as used herein, is not limited, except that it is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or backlighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosure (uniformly or non-uniformly).

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

The solid state light emitter (or solid state light emitters) used in the devices according to the present inventive subject matter, and the lumiphor (or lumiphors) used in the devices according to the present inventive subject matter, can be selected from among any solid state light emitters and lumiphors known to persons of skill in the art. Wide varieties of such solid state light emitters and lumiphors are readily obtainable and well known to those of skilled in the art, and any of them can be employed.

Examples of types of such solid state light emitters include light emitting diodes, including inorganic and organic light emitting diodes, a variety of each of which are well-known in the art. The solid state light emitters used in the devices according to the present invention can be light emitters which emit visible light, near UV light, UV light, infrared light, and/or combinations thereof.

The one or more luminescent materials can be any desired luminescent material. The one or more luminescent materials can be down-converting or up-converting, or can include a combination of both types. For example, the one or more luminescent materials can be selected from among phosphors, scintillators, day glow tapes, inks which glow in the visible spectrum upon illumination with ultraviolet light, etc.

The one or more luminescent materials can be provided in any desired form. For example, the luminescent element can be embedded in a resin (i.e., a polymeric matrix), such as a silicone material, an epoxy material, a glass material or a metal oxide material.

The one or more lumiphors can individually be any lumiphor, a wide variety of which, as noted above, are known to those skilled in the art. For example, the (or each of the) lumiphor(s) can comprise (or can consist essentially of, or can consist of) one or more phosphor. The (or each of the) one or more lumiphors can, if desired, further comprise (or consist essentially of, or consist of) one or more highly transmissive (e.g., transparent or substantially transparent, or somewhat diffuse) binder, e.g., made of epoxy, silicone, glass, metal oxide or any other suitable material (for example, in any given lumiphor comprising one or more binder, one or more phosphor can be dispersed within the one or more binder). For example, the thicker the lumiphor, in general, the lower the weight percentage of the phosphor can be.

The (or each of the) one or more lumiphors can, independently, further comprise any of a number of well-known additives, e.g., diffusers, scatterers, tints, etc.

Representative examples of suitable LEDs are described in:

(1) U.S. Patent Application No. 60/753,138, filed on Dec. 22, 2005, entitled "Lighting Device" (inventor: Gerald H. Negley) and U.S. patent application Ser. No. 11/614,180, filed Dec. 21, 2006 (now U.S. Patent Publication No. 2007/0236911), the entireties of which are hereby incorporated by reference;

(2) U.S. Patent Application No. 60/794,379, filed on Apr. 24, 2006, entitled "Shifting Spectral Content in LEDs by Spatially Separating Lumiphor Films" (inventors: Gerald H. Negley and Antony Paul van de Ven) and U.S. patent application Ser. No. 11/624,811, filed Jan. 19, 2007 (now U.S. Patent Publication No. 2007/0170447), the entireties of which are hereby incorporated by reference;

(3) U.S. Patent Application No. 60/808,702, filed on May 26, 2006, entitled "Lighting Device" (inventors: Gerald H. Negley and Antony Paul van de Ven) and U.S. patent application Ser. No. 11/751,982, filed May 22, 2007 (now U.S. Patent Publication No. 2007/0274080), the entireties of which are hereby incorporated by reference;

(4) U.S. Patent Application No. 60/808,925, filed on May 26, 2006, entitled "Solid State Light Emitting Device and Method of Making Same" (inventors: Gerald H. Negley and Neal Hunter) and U.S. patent application Ser. No. 11/753,103, filed May 24, 2007 (now U.S. Patent Publication No. 2007/0280624), the entireties of which are hereby incorporated by reference;

(5) U.S. Patent Application No. 60/802,697, filed on May 23, 2006, entitled "Lighting Device and Method of Making" (inventor: Gerald H. Negley) and U.S. patent application Ser. No. 11/751,990, filed May 22, 2007 (now U.S. Patent Publication No. 2007/0274063), the entireties of which are hereby incorporated by reference;

(6) U.S. Patent Application No. 60/839,453, filed on Aug. 23, 2006, entitled "LIGHTING DEVICE AND LIGHTING METHOD" (inventors: Antony Paul van de Ven and Gerald H. Negley) and U.S. patent application Ser. No. 11/843,243, filed Aug. 22, 2007 (now U.S. Patent Publication No. 2007/0084685), the entireties of which are hereby incorporated by reference;

(7) U.S. Patent Application No. 60/857,305, filed on Nov. 7, 2006, entitled "LIGHTING DEVICE AND LIGHTING METHOD", (inventors: Antony Paul van de Ven and Gerald H. Negley, the entirety of which is hereby incorporated by reference; and (8) U.S. Patent Application No. 60/851,230, filed on Oct. 12, 2006, entitled "LIGHTING DEVICE AND METHOD OF MAKING SAME", (inventor: Gerald H. Negley, the entirety of which is hereby incorporated by reference.

In some embodiments of the present inventive subject matter, there are further provided one or more switches electrically connected to one of respective power lines, whereby the switch selectively switches on and off current to the solid state light emitter(s) on the respective power line.

In some lighting devices according to the present inventive subject matter, there are further included one or more circuitry components, e.g., drive electronics for supplying and controlling current passed through at least one of the one or more solid state light emitters in the lighting device. Persons of skill in the art are familiar with a wide variety of ways to supply and control the current passed through solid state light emitters, and any such ways can be employed in the devices of the present inventive subject matter. For example, such circuitry can include at least one contact, at least one leadframe, at least one current regulator, at least one power control, at least one voltage control, at least one boost, at least one capacitor and/or at least one bridge rectifier, persons of skill in the art being familiar with such components and being readily able to design appropriate circuitry to meet whatever current flow characteristics are desired. For example, circuitry which may be used in practicing the present inventive subject matter is described in:

(1) U.S. Patent Application No. 60/752,753, filed on Dec. 21, 2005, entitled "Lighting Device" (inventors: Gerald H. Negley, Antony Paul van de Ven and Neal Hunter) and U.S. patent application Ser. No. 11/613,692, filed Dec. 20, 2006

(now U.S. Patent Publication No. 2007/0139923), the entireties of which are hereby incorporated by reference;

(2) U.S. Patent Application No. 60/798,446, filed on May 5, 2006, entitled "Lighting Device" (inventor: Antony Paul van de Ven) and U.S. patent application Ser. No. 11/743,754, filed May 3, 2007 (now U.S. Patent Publication No. 2007/0263393), the entireties of which are hereby incorporated by reference;

(3) U.S. Patent Application No. 60/809,959, filed on Jun. 1, 2006, entitled "Lighting Device With Cooling" (inventors: Thomas G. Coleman, Gerald H. Negley and Antony Paul van de Ven) and U.S. patent application Ser. No. 11/626,483, filed Jan. 24, 2007 (now U.S. Patent Publication No. 2007/0171145), the entireties of which are hereby incorporated by reference;

(4) U.S. Patent Application No. 60/809,595, filed on May 31, 2006, entitled "LIGHTING DEVICE AND METHOD OF LIGHTING" (inventor: Gerald H. Negley) and U.S. patent application Ser. No. 11/755,162, filed May 30, 2007 (now U.S. Patent Publication No. 2007/0279440), the entireties of which are hereby incorporated by reference; and (5) U.S. Patent Application No. 60/844,325, filed on Sep. 13, 2006, entitled "BOOST/FLYBACK POWER SUPPLY TOPOLOGY WITH LOW SIDE MOSFET CURRENT CONTROL"(inventor: Peter Jay Myers), and U.S. patent application Ser. No. 11/854,744, filed Sep. 13, 2007 (now U.S. Patent Publication No. 2008/0088248), the entireties of which are hereby incorporated by reference.

The present inventive subject matter further relates to an illuminated enclosure, comprising an enclosed space and at least one lighting device according to the present inventive subject matter, wherein the lighting device illuminates at least a portion of the enclosure.

The present inventive subject matter further relates to an illuminated surface, comprising a surface and at least one lighting device according to the present inventive subject matter, wherein the lighting device illuminates at least a portion of the surface.

The present inventive subject matter further relates to an illuminated area, comprising at least one area selected from among the group consisting of a swimming pool, a room, a warehouse, an indicator, a road, a vehicle, a road sign, a billboard, a ship, a boat, an aircraft, a stadium, a tree, a window, and a lamppost having mounted therein or thereon at least one lighting device according to the present inventive subject matter.

In addition, persons of skill in the art are familiar with a wide variety of mounting structures for many different types of lighting, and any such structures can be used according to the present inventive subject matter. For example, FIG. 4 depicts a first embodiment of a lighting device in accordance with the present inventive subject matter.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

Figure 4:
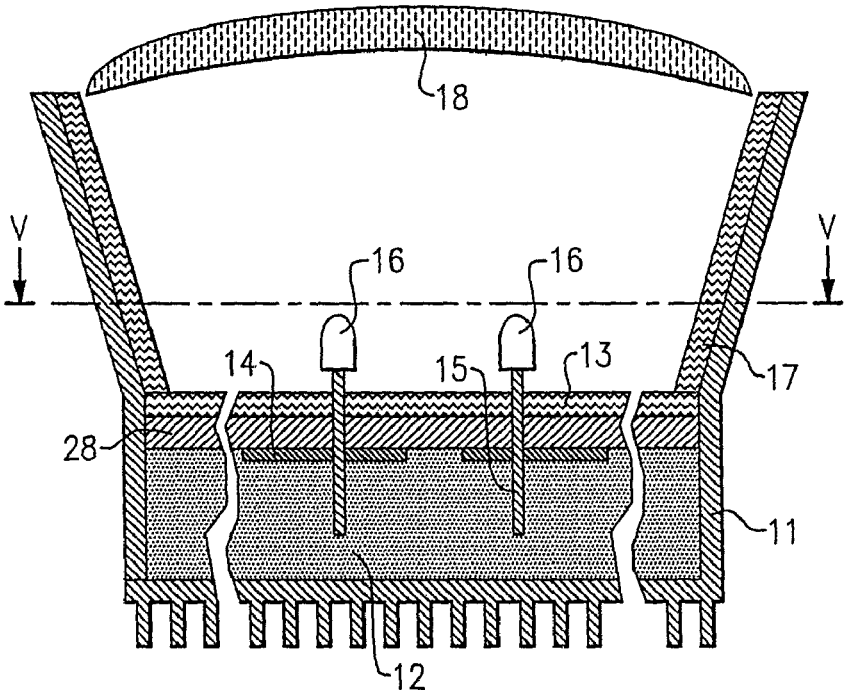
FIG. 4 depicts a first embodiment of a lighting device in accordance with the present inventive subject matter.

Referring to FIG. 4, there is shown a lighting device which includes a heat spreading element 11 (formed of aluminum), insulating regions 12 (comprising any desired material which is thermally conductive and not electrically conductive, a wide variety of which are well-known to those skilled in the art, e.g., ceramic, epoxy or silicone optionally filled with silicon carbide, diamond, cubic boron nitride, alumina, etc), a highly reflective surface 13 (formed in situ by polishing the surface of the aluminum heat spreading element, or made of MCPET® (marketed by Furukawa, a Japanese corporation)), conductive traces 14 formed of copper, lead flames 15 formed of silver-plated copper (or silver-plated mild steel), packaged LEDs 16, a reflective cone 17 (made of MCPET®) (marketed by Furukawa, a Japanese corporation) with a diffuse light scattering surface and a diffusing element 18 (the diffusing element 18 performs a light scattering function).

The thickness of the heat spreading element 11 is about 3.0 mm.

The reflective cone 17 is about 1 mm thick.

The diffusing element 18 is about 3.0 mm thick and is made of glass or plastic with surface features.

The device depicted in FIG. 4 further includes a printed circuit board (PCB) 28 with the conductive traces 14. The PCB is about 1.6 mm thick and is FR4.

In some embodiments according to the present inventive subject matter, one or more of the solid state light emitters can be included in a package together with one or more of the lumiphors, and the one or more lumiphor in the package can be spaced from the one or more solid state light emitter in the package to achieve improved light extraction efficiency, as described in U.S. Patent Application No. 60/753,138, filed on Dec. 22, 2005, entitled "Lighting Device" (inventor: Gerald H. Negley) and U.S. patent application Ser. No. 11/614,180, filed Dec. 21, 2006 (now U.S. Patent Publication No. 2007/0236911), the entireties of which are hereby incorporated by reference.

Figure 5:
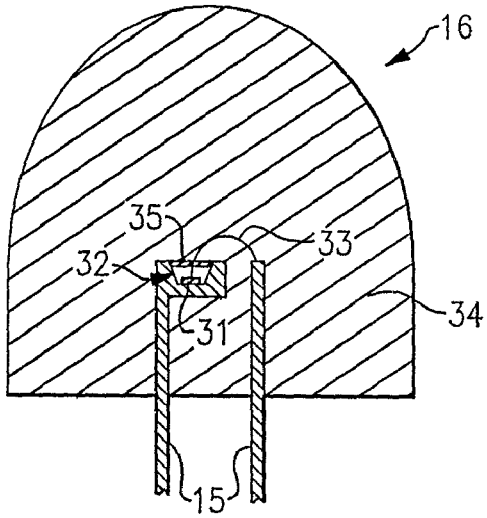
FIG. 5 depicts a representative example of a packaged LED which can be used in the devices according to the present inventive subject matter.

FIG. 5 depicts a representative example of a packaged LED which can be used in the devices according to the present inventive subject matter. Referring to FIG. 5, there is shown a packaged LED 16 which comprises a blue light emitting diode chip 31 (namely, a Cree XT LED (C460XT290) die with a wavelength range of from about 450 nm to about 465 nm, and optical power greater than 24 mW), a lead frame 15 having a reflective surface 32, a copper wire 33, an encapsulant region 34, and a broad spectrum emitting lumiphor 35. The reflective surface 32 is made of silver. The encapsulant region 34 is made of Hysol OS400 or GE/Toshiba Invisil 5332. The lumiphor 35 comprises a luminescent material consisting of QMK58/F-U1 YAG:Ce by Phosphor Teck—UK dispersed in a binder made of Hysol OS400 or GE/Toshiba 5332. The luminescent material is loaded in the binder in an amount in the range of from about 10 to about 12 percent by weight, based on the total weight of the binder and the luminescent material. The luminescent material particles have particle sizes in the range of from about 1.6 micrometers to about 8.6 micrometers, with the mean particle size being in the range of from about 4 micrometers to about 5 micrometers. The lumiphor 35 is spaced from the chip 31 by a distance in the range of from about 100 micrometers to about 750 micrometers (for example, from about 500 micrometers to about 750 micrometers, e.g., about 750 micrometers). The blue chip 31 emits light having a peak wavelength in the range of from about 450 nm to about 465 nm.

In some embodiments according to the present inventive subject matter, two or more lumiphors can be provided, two or more of the lumiphors being spaced from each other, as described in U.S. Patent Application No. 60/794,379, filed on Apr. 24, 2006, entitled "Shifting Spectral Content in LEDs by Spatially Separating Lumiphor Films" (inventors: Gerald H. Negley and Antony Paul van de Ven) and U.S. patent application Ser. No. 11/624,811, filed Jan. 19, 2007 (now U.S. Patent Publication No. 2007/0170447), the entireties of which are hereby incorporated by reference.

In some lighting devices according to the present inventive subject matter, there are further included one or more power sources, e.g., one or more batteries and/or solar cells, and/or one or more standard AC power plugs.

The lighting devices according to the present inventive subject matter can comprise any desired number of LEDs and lumiphors. For example, a lighting device according to the present inventive subject matter can include 50 or more light emitting diodes, or can include 100 or more light emitting diodes, etc.

The sources of visible light in the lighting devices of the present inventive subject matter can be arranged, mounted and supplied with electricity in any desired manner, and can be mounted on any desired housing or fixture. Skilled artisans are familiar with a wide variety of arrangements, mounting schemes, power supplying apparatuses, housings and fixtures, and any such arrangements, schemes, apparatuses, housings and fixtures can be employed in connection with the present inventive subject matter. The lighting devices of the present inventive subject matter can be electrically connected (or selectively connected) to any desired power source, persons of skill in the art being familiar with a variety of such power sources.

Representative examples of arrangements of sources of visible light, schemes for mounting sources of visible light, apparatus for supplying electricity to sources of visible light, housings for sources of visible light, fixtures for sources of visible light and power supplies for sources of visible light, all of which are suitable for the lighting devices of the present inventive subject matter, are described in U.S. Patent Application No. 60/752,753, filed on Dec. 21, 2005, entitled "Lighting Device" (inventors: Gerald H. Negley, Antony Paul van de Ven and Neal Hunter) and U.S. patent application Ser. No. 11/613,692, filed Dec. 20, 2006 (now U.S. Patent Publication No. 2007/0139923), the entireties of which are hereby incorporated by reference.

Any two or more structural parts of the lighting devices described herein can be integrated. Any structural part of the lighting devices described herein can be provided in two or more parts (which can be held together, if necessary).

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A lighting device comprising:

a first group of solid state light emitters; and a first group of lumiphors;

wherein:

if each of said first group of solid state light emitters is illuminated and each of said first group of lumiphors is excited, a mixture of light emitted from said first group of solid state light emitters and said first group of lumiphors would, in the absence of any additional light, have a first group mixed illumination having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, said fourth line segment connecting said fourth point to said first point, said first point having x, y coordinates of 0.32, 0.40, said second point having x, y coordinates of 0.36, 0.38, said third point having x, y coordinates of 0.41, 0.455, and said fourth point having x, y coordinates of 0.36, 0.48.

2. A lighting device as recited in claim 1, wherein:

each of said first group of solid state light emitters, if illuminated, would emit light having a peak wavelength in the range of from 430 nm to 480 nm;

each of said first group of lumiphors, if excited, would emit light having a dominant wavelength in the range of from about 555 nm to about 585 nm.

3. A lighting device as recited in claim 2, wherein:

said first group of solid state light emitters comprises all of the solid state light emitters in said lighting device which, if illuminated, would emit light having a peak wavelength in the range of from about 430 nm to about 480 nm; and said first group of lumiphors comprises all of the lumiphors in said lighting device which, if excited, would emit light having a dominant wavelength in the range of from about 555 nm to about 585 nm.

4. A lighting device as recited in claim 1, further comprising at least one power line, said first group of solid state light emitters comprising all solid state light emitters which, if illuminated, would emit light having a peak wavelength in the range of from 430 nm to 480 nm, and wherein each of said first group of solid state light emitters is illuminated if power is supplied to said at least one power line.

5. A lighting device as recited in claim 4, wherein said first group of lumiphors comprises all of the lumiphors in said lighting device which, if excited, would emit light having a dominant wavelength in the range of from about 555 nm to about 585 nm, and each of said first group of lumiphors is illuminated if power is supplied to said at least one power line.

6. A lighting device as recited in claim 1, wherein if every solid state light emitter in said lighting device is illuminated, said lighting device would emit light having x, y color coordinates which define a point which is within an area on a 1931

CIE Chromaticity Diagram enclosed by first, second, third and fourth line segments, said first line segment connecting a first point to a second point, said second line segment connecting said second point to a third point, said third line segment connecting said third point to a fourth point, said fourth line segment connecting said fourth point to said first point, said first point having x, y coordinates of 0.32, 0.40, said second point having x, y coordinates of 0.36, 0.38, said third point having x, y coordinates of 0.41, 0.455, and said fourth point having x, y coordinates of 0.36, 0.48.

7. A lighting device as recited in claim 1, wherein said lighting device further comprises at least one power line, and if power is supplied to each of said at least one power line, said lighting device would emit light having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, said fourth line segment connecting said fourth point to said first point, said first point having x, y coordinates of 0.32, 0.40, said second point having x, y coordinates of 0.36, 0.38, said third point having x, y coordinates of 0.41, 0.455, and said fourth point having x, y coordinates of 0.36, 0.48.

8. A lighting device as recited in claim 1, wherein said lighting device further comprises a second group of solid state light emitters, said second group of solid state light emitters comprising at least one second group solid state light emitter, wherein each said second group solid state light emitter, if illuminated, would emit saturated light.

9. A lighting device comprising:

a first group of solid state light emitters; and a first group of lumiphors;

wherein:

if each of said first group of solid state light emitters is illuminated and each of said first group of lumiphors is excited, a mixture of light emitted from said first group of solid state light emitters and said first group of lumiphors would, in the absence of any additional light, have a first group mixed illumination having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, said fourth line segment connecting said fourth point to said first point, said first point, having x, y coordinates of 0.36, 0.48, said second point having x, y coordinates of 0.43, 0.45, said third point having x, y coordinates of 0.5125, 0.4866, and said fourth point having x, y coordinates of 0.4087, 0.5896.

10. A lighting device as recited in claim 9, further comprising at least one power line, said first group of solid state light emitters comprising all solid state light emitters which, if illuminated, would emit light having a peak wavelength in the range of from 430 nm to 480 nm, and wherein each of said first group of solid state light emitters is illuminated if power is supplied to said at least one power line.

11. A lighting device as recited in claim 10, wherein said first group of lumiphors comprises all of the lumiphors in said lighting device which, if excited, would emit light having a dominant wavelength in the range of from about 555 nm to about 585 nm, and each of said first group of lumiphors is illuminated if power is supplied to said at least one power line.

12. A lighting device comprising:

a first group of solid state light emitters; and a first group of lumiphors;

wherein:

if each of said first group of solid state light emitters is illuminated and each of said first group of lumiphors is excited, a mixture of light emitted from said first group of solid state light emitters and said first group of lumiphors would, in the absence of any additional light, have a first group mixed illumination having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, said fourth line segment connecting said fourth point to said first point, said first point having x, y coordinates of 0.41, 0.455 said second point having x, y coordinates of 0.36, 0.48, said third point having x, y coordinates of 0.4087, 0.5896, and said fourth point having x, y coordinates of 0.4788, 0.5202.

13. A lighting device as recited in claim 12, further comprising at least one power line, said first group of solid state light emitters comprising all solid state light emitters which, if illuminated, would emit light having a peak wavelength in the range of from 430 nm to 480 nm, and wherein each of said first group of solid state light emitters is illuminated if power is supplied to said at least one power line.

14. A lighting device comprising:

a first group of solid state light emitters;

a first group of lumiphors;

a second group of solid state light emitters; and a second group of lumiphors;

wherein:

if each of said first group of solid state light emitters is illuminated and each of said first group of lumiphors is excited, a mixture of light emitted from said first group of solid state light emitters and said first group of lumiphors would, in the absence of any additional light, have a first group mixed illumination having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, and said fourth line segment connecting said fourth point to said first point, said first point having x, y coordinates of 0.36, 0.48, said second point having x, y coordinates of 0.43, 0.45, said third point having x, y coordinates of 0.5125, 0.4866, and said fourth point having x, y coordinates of 0.4087, 0.5896;

if each of said second group of solid state light emitters is illuminated and each of said second group of lumiphors is excited, a mixture of light emitted from said second group of solid state light emitters and said second group of lumiphors would, in the absence of any additional light, have a second group mixed illumination having x, y color coordinates which define a point which is within an area on a 1931 CIE Chromaticity Diagram enclosed by fifth, sixth, seventh and eighth line segments, said fifth line segment connecting a fifth point to a sixth point, said sixth line segment connecting said sixth point to a seventh point, said seventh line segment connecting said seventh point to an eighth point, and said eighth line segment connecting said eighth point to said fifth point, said fifth point having x, y coordinates of 0.32, 0.40, said sixth point having x, y coordinates of 0.36, 0.38, said seventh point having x, y coordinates of 0.30, 0.26, and said eighth point having x, y coordinates of 0.25, 0.29;

if each of said first group of solid state light emitters and said second group of solid state light emitters is illuminated and each of said first group of lumiphors and said second group of lumiphors is excited, a mixture of light emitted from said first group of solid state light emitters, said second group of solid state light emitters, said first group of lumiphors and said second group of lumiphors would, in the absence of any additional light, have a first group-second group mixed illumination having x, y color coordinates which define a point which is within an area on a 1931 CIE Chromaticity Diagram enclosed by ninth, tenth, eleventh, twelfth and thirteenth line segments, said ninth line segment connecting a ninth point to a tenth point, said tenth line segment connecting said tenth point to an eleventh point, said eleventh line segment connecting said eleventh point to a twelfth point, said twelfth line segment connecting said twelfth point to a thirteenth point, and said thirteenth line segment connecting said thirteenth point to said ninth point, said ninth point having x, y coordinates of 0.32, 0.40, said tenth point having x, y coordinates of 0.36, 0.48, said eleventh point having x, y coordinates of 0.43, 0.45, said twelfth point having x, y coordinates of 0.42, 0.42, and said thirteenth point having x, y coordinates of 0.36, 0.38.

15. A lighting device as recited in claim 14, wherein:

each of said first group of solid state light emitters and said second group of solid state light emitters, if illuminated, would emit light having a peak wavelength in the range of from 430 nm to 480 nm;

each of said first group of lumiphors and said second group of lumiphors, if excited, would emit light having a dominant wavelength in the range of from about 555 nm to about 585 nm.

16. A lighting device as recited in claim 14, further comprising at least one power line, said first and second groups of solid state light emitters together comprising all solid state light emitters which, if illuminated, would emit light having a peak wavelength in the range of from 430 nm to 480 nm, and wherein each of said first and second groups of solid state light emitters are illuminated if power is supplied to said at least one power line.

17. A lighting device as recited in claim 16, wherein said first and second groups of lumiphors together comprise all of the lumiphors in said lighting device which, if excited, would emit light having a dominant wavelength in the range of from about 555 nm to about 585 nm, and each of said first and second groups of lumiphors is illuminated if power is supplied to said at least one power line.

18. A lighting device as recited in claim 14, wherein if every LED in said lighting device is illuminated, said lighting device would emit light having x, y color coordinates which define a point which is within an area on a 1931 CIE Chromaticity Diagram enclosed by first, second, third, fourth and fifth line segments, said first line segment connecting a first point to a second point, said second line segment connecting said second point to a third point, said third line segment connecting said third point to a fourth point, said fourth line segment connecting said fourth point to said fifth point, said fifth line segment connecting said fifth point to said first point, said first point having x, y coordinates of 0.32, 0.40, said second point having x, y coordinates of 0.36, 0.48, said third point having x, y coordinates of 0.43, 0.45, said fourth point having x, y coordinates of 0.42, 0.42, and said fifth point having x, y coordinates of 0.36, 0.38.

19. A lighting device as recited in claim 14, wherein said lighting device further comprises at least one power line, and if power is supplied to each of said at least one power line, said lighting device would emit light having x, y color coordinates which define a point which is within an area on a 1931 CIE Chromaticity Diagram enclosed by enclosed by first, second, third, fourth and fifth line segments, said first line segment connecting a first point to a second point, said second line segment connecting said second point to a third point, said third line segment connecting said third point to a fourth point, said fourth line segment connecting said fourth point to said fifth point, said fifth line segment connecting said fifth point to said first point, said first point having x, y coordinates of 0.32, 0.40, said second point having x, y coordinates of 0.36, 0.48, said third point having x, y coordinates of 0.43, 0.45, said fourth point having x, y coordinates of 0.42, 0.42, and said fifth point having x, y coordinates of 0.36, 0.38.

20. A lighting device comprising:

a first group of solid state light emitters;

a first group of lumiphors;

a second group of solid state light emitters; and a second group of lumiphors;

wherein:

if each of said first group of solid state light emitters is illuminated and each of said first group of lumiphors is excited, a mixture of light emitted from said first group of solid state light emitters and said first group of lumiphors would, in the absence of any additional light, have a first group mixed illumination having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, and said fourth line segment connecting said fourth point to said first point, said first point having x, y coordinates of 0.41, 0.455 said second point having x, y coordinates of 0.36, 0.48, said third point having x, y coordinates of 0.4087, 0.5896, and said fourth point having x, y coordinates of 0.4788, 0.5202;

if each of said second group of solid state light emitters is illuminated and each of said second group of lumiphors is excited, a mixture of light emitted from said second group of solid state light emitters and said second group of lumiphors would, in the absence of any additional light, have a second group mixed illumination having x, y color coordinates which define a point which is within an area on a 1931 CIE Chromaticity Diagram enclosed by fifth, sixth, seventh and eighth line segments, said fifth line segment connecting a fifth point to a sixth point, said sixth line segment connecting said sixth point to a seventh point, said seventh line segment connecting said seventh point to an eighth point, and said eighth line segment connecting said eighth point to said fifth point, said fifth point having x, y coordinates of 0.32, 0.40, said sixth point having x, y coordinates of 0.36, 0.38, said seventh point having x, y coordinates of 0.30, 0.26, and said eighth point having x, y coordinates of 0.25, 0.29;

if each of said first group of solid state light emitters and said second group of solid state light emitters is illuminated and each of said first group of lumiphors and said second group of lumiphors is excited, a mixture of light emitted from said first group of solid state light emitters, said second group of solid state light emitters, said first group of lumiphors and said second group of lumiphors would, in the absence of any additional light, have a first group-second group mixed illumination having x, y color coordinates which define a point which is within an area on a 1931 CIE Chromaticity Diagram enclosed by ninth, tenth, eleventh and twelfth line segments, said ninth line segment connecting a ninth point to a tenth point, said tenth line segment connecting said tenth point to an eleventh point, said eleventh line segment connecting said eleventh point to a twelfth point, said twelfth line segment connecting said twelfth point to said ninth point, said ninth point having x, y coordinates of 0.32, 0.40, said tenth point having x, y coordinates of 0.36, 0.38, said eleventh point having x, y coordinates of 0.41, 0.455, and said twelfth point having x, y coordinates of 0.36, 0.48.

21. A lighting device as recited in claim 20, wherein:

each of said first group of solid state light emitters and said second group of solid state light emitters, if illuminated, would emit light having a peak wavelength in the range of from 430 nm to 480 nm;

each of said first group of lumiphors and said second group of lumiphors, if excited, would emit light having a dominant wavelength in the range of from about 555 nm to about 585 nm.

22. A lighting device as recited in claim 20, further comprising at least one power line, said first and second groups of solid state light emitters together comprising all solid state light emitters which, if illuminated, would emit light having a peak wavelength in the range of from 430 nm to 480 nm, and wherein each of said first and second groups of solid state light emitters is illuminated if power is supplied to said at least one power line.

23. A lighting device as recited in claim 22, wherein said first and second groups of lumiphors together comprise all of the lumiphors in said lighting device which, if excited, would emit light having a dominant wavelength in the range of from about 555 nm to about 585 nm, and each of said first and second groups of lumiphors is illuminated if power is supplied to said at least one power line.

24. A lighting device as recited in claim 20, wherein if every LED in said lighting device is illuminated, said lighting device would emit light having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, said fourth line segment connecting said fourth point to said first point, said first point having x, y coordinates of 0.32, 0.40, said second point having x, y coordinates of 0.36, 0.38, said third point having x, y coordinates of 0.41, 0.455, and said fourth point having x, y coordinates of 0.36, 0.48.

25. A lighting device as recited in claim 20, wherein said lighting device further comprises at least one power line, and if power is supplied to each of said at least one power line, said lighting device would emit light having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, said fourth line segment connecting said fourth point to said first point, said first point having x, y coordinates of 0.32, 0.40, said second point having x, y coordinates of 0.36, 0.38, said third point having x, y coordinates of 0.41, 0.455, and said fourth point having x, y coordinates of 0.36, 0.48.

26. A method of lighting, comprising:

mixing light from a first group of at least one solid state light emitter and light from a first group of at least one lumiphor to form first group mixed illumination;

said first group mixed illumination having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, said fourth line segment connecting said fourth point to said first point, said first point having x, y coordinates of 0.32, 0.40, said second point having x, y coordinates of 0.36, 0.38, said third point having x, y coordinates of 0.41, 0.455, and said fourth point having x, y coordinates of 0.36, 0.48.

27. A method as recited in claim 26, wherein:

said light from each of said first group of at least one solid state light emitter has a peak wavelength in the range of from 430 nm to 480 nm; and said light from each of said first group of at least one lumiphor has a dominant wavelength in the range of from 555 nm to 585 nm.

28. A method of lighting, comprising:

mixing light from a first group of at least one solid state light emitter and light from a first group of at least one lumiphor to form first group mixed illumination;

said first group mixed illumination having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, said fourth line segment connecting said fourth point to said first point, said first point having x, y coordinates of 0.36, 0.48, said second point having x, y coordinates of 0.43, 0.45, said third point having x, y coordinates of 0.5125, 0.4866, and said fourth point having x, y coordinates of 0.4087, 0.5896.

29. A method as recited in claim 28, wherein:

said light from each of said first group of at least one solid state light emitter has a peak wavelength in the range of from 430 nm to 480 nm; and said light from each of said first group of at least one lumiphor has a dominant wavelength in the range of from 555 nm to 585 nm.

30. A method of lighting, comprising:

mixing light from a first group of at least one solid state light emitter and light from a first group of at least one lumiphor to form first group mixed illumination;

said first group mixed illumination having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, said fourth line segment connecting said fourth point to said first point, said first point having x, y coordinates of 0.41, 0.455 said second point having x, y coordinates of 0.36, 0.48, said third point having x, y coordinates of 0.4087, 0.5896, and said fourth point having x, y coordinates of 0.4788, 0.5202.

31. A method as recited in claim 30, wherein:

said light from each of said first group of at least one solid state light emitter has a peak wavelength in the range of from 430 nm to 480 nm; and said light from each of said first group of at least one lumiphor has a dominant wavelength in the range of from 555 nm to 585 nm.

32. A method of lighting, comprising:

mixing light from a first group of at least one solid state light emitter, light from a second group of at least one solid state light emitter, light from a first group of at least one lumiphor and light from a second group of at least one lumiphor to form first group-second group mixed illumination;

said first group-second group mixed illumination having x, y color coordinates which define a point which is within an area on a 1931 CIE Chromaticity Diagram enclosed by ninth, tenth, eleventh, twelfth and thirteenth line segments, said ninth line segment connecting a ninth point to a tenth point, said tenth line segment connecting said tenth point to an eleventh point, said eleventh line segment connecting said eleventh point to a twelfth point, said twelfth line segment connecting said twelfth point to a thirteenth point, and said thirteenth line segment connecting said thirteenth point to said ninth point, said ninth point having x, y coordinates of 0.32, 0.40, said tenth point having x, y coordinates of 0.36, 0.48, said eleventh point having x, y coordinates of 0.43, 0.45, said twelfth point having x, y coordinates of 0.42, 0.42, and said thirteenth point having x, y coordinates of 0.36, 0.38, wherein:

a mixture of light emitted from said first group of solid state light emitters and said first group of lumiphors would, in the absence of any additional light, have a first group mixed illumination having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, and said fourth line segment connecting said fourth point to said first point, said first point having x, y coordinates of 0.36, 0.48, said second point having x, y coordinates of 0.43, 0.45, said third point having x, y coordinates of 0.5125, 0.4866, and said fourth point having x, y coordinates of 0.4087, 0.5896, and a mixture of light emitted from said second group of solid state light emitters and said second group of lumiphors would, in the absence of any additional light, have a second group mixed illumination having x, y color coordinates which define a point which is within an area on a 1931 CIE Chromaticity Diagram enclosed by fifth, sixth, seventh and eighth line segments, said fifth line segment connecting a fifth point to a sixth point, said sixth line segment connecting said sixth point to a seventh point, said seventh line segment connecting said seventh point to an eighth point, and said eighth line segment connecting said eighth point to said fifth point, said fifth point having x, y coordinates of 0.32, 0.40, said sixth point having x, y coordinates of 0.36, 0.38, said seventh point having x, y coordinates of 0.30, 0.26, and said eighth point having x, y coordinates of 0.25, 0.29.

33. A method as recited in claim 32, wherein:

said light from each of said first group of at least one solid state light emitter and each of said second group of at least one solid state light emitter has a peak wavelength in the range of from 430 nm to 480 nm; and said light from each of said first group of at least one lumiphor and each of said second group of at least one lumiphor has a dominant wavelength in the range of from 555 nm to 585 nm.

34. A method of lighting, comprising:

mixing light from a first group of at least one solid state light emitter, light from a second group of at least one solid state light emitter, light from a first group of at least one lumiphor and light from a second group of at least one lumiphor to form first group-second group mixed illumination;

said first group-second group mixed illumination having x, y color coordinates which define a point which is within an area on a 1931 CIE Chromaticity Diagram enclosed by ninth, tenth, eleventh and twelfth line segments, said ninth line segment connecting a ninth point to a tenth point, said tenth line segment connecting said tenth point to an eleventh point, said eleventh line segment connecting said eleventh point to a twelfth point, said twelfth line segment connecting said twelfth point to said ninth point, said ninth point having x, y coordinates of 0.32, 0.40, said tenth point having x, y coordinates of 0.36, 0.38, said eleventh point having x, y coordinates of 0.41, 0.455, and said twelfth point having x, y coordinates of 0.36, 0.48, wherein:

a mixture of light emitted from said first group of solid state light emitters and said first group of lumiphors would, in the absence of any additional light, have a first group mixed illumination having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, and said fourth line segment connecting said fourth point to said first point, said first point having x, y coordinates of 0.41, 0.455 said second point having x, y coordinates of 0.36, 0.48, said third point having x, y coordinates of 0.4087, 0.5896, and said fourth point having x, y coordinates of 0.4788, 0.5202, and a mixture of light emitted from said second group of solid state light emitters and said second group of lumiphors would, in the absence of any additional light, have a second group mixed illumination having x, y color coordinates which define a point which is within an area on a 1931 CIE Chromaticity Diagram enclosed by fifth, sixth, seventh and eighth line segments, said fifth line segment connecting a fifth point to a sixth point, said sixth line segment connecting said sixth point to a seventh point, said seventh line segment connecting said seventh point to an eighth point, and said eighth line segment connecting said eighth point to said fifth point, said fifth point having x, y coordinates of 0.32, 0.40, said sixth point having x, y coordinates of 0.36, 0.38, said seventh point having x, y coordinates of 0.30, 0.26, and said eighth point having x, y coordinates of 0.25, 0.29.

35. A method as recited in claim 34, wherein:

said light from each of said first group of at least one solid state light emitter and each of said second group of at least one solid state light emitter has a peak wavelength in the range of from 430 nm to 480 nm; and said light from each of said first group of at least one lumiphor and each of said second group of at least one lumiphor has a dominant wavelength in the range of from 555 nm to 585 nm.

* * * * *